US009011307B2

(12) United States Patent
Trani et al.

(10) Patent No.: US 9,011,307 B2
(45) Date of Patent: Apr. 21, 2015

(54) METHOD FOR MANUFACTURING A PAPER CONTAINER

(75) Inventors: Giorgio Trani, Venice (IT); Gianmario Anghileri, Malgrate (IT); Marion Sterner, Venice (IT)

(73) Assignee: Novacart S.p.A. (IT)

( * ) Notice: Subject to any disclaimer, the term of this patent is extended or adjusted under 35 U.S.C. 154(b) by 804 days.

(21) Appl. No.: 13/263,818

(22) PCT Filed: Mar. 22, 2010

(86) PCT No.: PCT/IB2010/000634

§ 371 (c)(1), (2), (4) Date: Dec. 15, 2011

(87) PCT Pub. No.: WO2010/116223

PCT Pub. Date: Oct. 14, 2010

(65) Prior Publication Data

US 2012/0108407 A1 May 3, 2012

(30) Foreign Application Priority Data

Apr. 10, 2009 (IT) ..... MI2009A0594
Apr. 10, 2009 (IT) ..... MI2009A0596

(51) Int. Cl.
*B31B 1/00* (2006.01)
*B65D 43/02* (2006.01)
(Continued)

(52) U.S. Cl.
CPC ..... *B65D 43/0231* (2013.01); *B31B 43/00* (2013.01); *B31B 2201/223* (2013.01);
(Continued)

(58) Field of Classification Search
CPC ..... B65D 3/06; B65D 3/26; B65D 3/16; B65D 3/266; B65D 3/268; B65D 51/20; B65D 51/28; B31B 43/00
USPC ..... 493/36, 52, 162, 102–105, 108–109, 493/136, 143, 159, 214, 59, 152–154
See application file for complete search history.

(56) References Cited

U.S. PATENT DOCUMENTS 2,177,652 A * 10/1939 Hill ..... 493/154
2,382,873 A 8/1945 Goodwin
(Continued)

FOREIGN PATENT DOCUMENTS

CH 178769 10/1935
EP 0453573 A1 10/1991
(Continued)

OTHER PUBLICATIONS

International Search Report and Written Opinion, dated Sep. 27, 2011, received from the European Patent Office in connection with International Application No. PCT/IB2010/000634.
(Continued)

*Primary Examiner* — Thanh Truong
*Assistant Examiner* — Xavier A Madison
(74) *Attorney, Agent, or Firm* — Meunier Carlin & Curfman, LLC

(57) ABSTRACT

A process for realizing a container from a foldable sheet comprises stages of at least partially inserting a closure element made of paper material (extensible paper) provided with a base wall and a lateral wall internally of a housing chamber of the container. The lateral wall of the closure element is inserted and located at a portion of the wall of the container. Also comprised is a stage of contemporary deformation of the lateral wall of the closure element and the portion of wall of the container in order to realize corresponding grooves on the parts, destined to define coupling and decoupling surfaces by rotation between the closure element and the container. The use of extensible paper advantageously enables easy realization of the coupling grooves by rotation.

12 Claims, 20 Drawing Sheets

(51) Int. Cl.

| | |
|---|---|
| ***B31B 43/00*** | (2006.01) |
| ***B65D 51/20*** | (2006.01) |
| ***B65D 51/28*** | (2006.01) |

(52) U.S. Cl.

CPC ..... *B65D43/0229* (2013.01); *B65D 51/20* (2013.01); *B65D 51/28* (2013.01); *B65D 2251/0018* (2013.01); *B65D 2251/0093* (2013.01); *B65D 2543/00046* (2013.01); *B65D 2543/00092* (2013.01); *B65D 2543/00268* (2013.01); *B65D 2543/00425* (2013.01); *B65D 2543/00509* (2013.01); *B65D 2543/00546* (2013.01); *B65D 2543/00555* (2013.01)

(56) References Cited

U.S. PATENT DOCUMENTS

| | | | | |
|---|---|---|---|---|
| 2,395,209 | A | 2/1946 | Zesbaugh | |
| 2,581,539 | A * | 1/1952 | Keith | 493/85 |
| 3,301,464 | A | 1/1967 | Amberg | |
| 2004/0056080 | A1 | 3/2004 | Johansson et al. | |
| 2008/0264895 | A1 | 10/2008 | Prieto et al. | |

FOREIGN PATENT DOCUMENTS

| | | | |
|---|---|---|---|
| EP | 1057748 | A1 | 12/2000 |
| GB | 428909 | A | 5/1935 |
| GB | 468161 | A | 6/1937 |
| GB | 643674 | | 9/1950 |
| GB | 688545 | | 3/1953 |
| GB | 848835 | | 9/1960 |
| GB | 2409964 | A | 7/2005 |
| WO | 2010116223 | A2 | 10/2010 |

OTHER PUBLICATIONS

International Preliminary Report on Patentability and Written Opinion, dated Oct. 11, 2011, received from the European Patent Office in connection with International Application No. PCT/IB2010/000634.

* cited by examiner

METHOD FOR MANUFACTURING A PAPER CONTAINER

FIELD

The present description relates to a container made of paper material (for example extensible paper) provided with a main part and special closure elements, and the relative production process.

In particular, the description relates to a paper container provided with a closing lid which is screwable and unscrewable, also made of paper, such as an extensible paper.

BACKGROUND

As is known, the use of containers made of paper, especially for containing comestible products, is very wide-spread on the market.

It is further known that some types of containers require the use of lids or is covering elements able to maintain the product insulated and container more efficiently, if not actually sealed (sealed from air and liquids) internally of the container compartment.

Consider for example beakers for containing soft drinks, such as orangeade, or sweet drinks, coffee.

With the aim of avoiding spillage of liquids, or contamination thereof, lids made of moulded plastic material have been realised, which can grip by snap-fitting to the reinforced edge of the paper beaker.

It is clear that this type of product, though being widely available on the market, is prey to some drawbacks connected in particular to the disposal of different materials (paper and plastic) internally of a same product.

Further, the sealing performances of the container are not high, due to the type of coupling realised. For example, if the beaker is crushed the plastic lid comes away.

With the aim of at least possibly obviating the drawbacks, GB patent 688545 describes the realisation of containers and lids made of paper material, wherein the container and lid are screwable at an external threading of the container mouth.

However the realisation of the external threading is complex, as it is necessary to work by crushing and deformation of the neck of the container in a way which is difficult to control and structurally not very resistant.

Also, patent GB643674 relates to an improvement for closing lids for bottles illustrates a structure in which the paper material lid, specially threaded, is extremely complex and defined by a plurality of flat superposed paper layers, glued and specially deformed.

It is obvious that even this type of product is complex and expensive to realise, as well as not very reliable.

A further improvement relating to paper material container and their threaded closure elements is described in document GB 428909 which illustrates a beaker structure in which the upper portion is threaded such as to receive an upturned is lid whose corresponding threading is, in use, arranged internally of the container containing chamber of the beaker, as is clearly illustrated in the figures appended to the description.

Also with reference to the above patent, there are some drawbacks in particular connected to the requisite of sealing which the threaded paper material lids should have, but which they do not succeed in guaranteeing.

In particular, document GB 468161 addresses this problem, signalling the difficulty of realising threading on the neck of the container and on the lid that actually substantially coincide, such as to guarantee optimal seal of the fluid in the container.

With the aim of obviating the cited drawback, document GB 468161 describes realising threading on the container and the lids which are slightly different, such that during the stage of fitting the lid on the container, a further interference force is generated which improves the seal of the container.

It is however clear that this type of solution leads to the need to realise two different devices, of which the first has the task of realising the threading on the paper container and the second has the task of realising the different threading on the lid, in a controlled and different way.

Each type of container comprises the realisation of machines dedicated to the above-evidenced aims.

From the point of view of the production methodologies of the containers with a lid made of paper material, sole mention is made here of GB patent GB2382873, which illustrates a method for producing a threaded lid.

In particular the apparatus used exploits the presence of a plurality of expandable sectors positioned internally of the structure of the lid to be realised, which move radially and impress on the internal surface of the lateral wall of the lid a spiral groove.

It should be noted however that the methodology of the above GB patent has the drawback of realising interrupted threads.

In fact, the expansion of the male-threaded angular sectors internally of the lid is necessarily leaves undeformed zones on the lid, due to the necessary stresses when opening.

This leads to interruptions in the shape of the thread which consequently generate de-alignments of the lid during the stage of screwing and/or causing deformation stress on the lid itself such as to cause the lid to lose grip on the container.

SUMMARY

In this situation the technical objective at the base of some of the described embodiments is thus to substantially resolve all the above-evidenced drawbacks. A first aim of some embodiments is to make available a productive type for paper material containers provided with screwable lids (also made of paper), which is easy to implement and which guarantees optimal seal for the product contained internally, thus enabling a simple and repeated opening and closing of the container.

The aim of some embodiments is also to provide a method and realisation of the above-cited system which can be exploited both during the production stage and in the packaging stage, guaranteeing considerable advantages in both situations. An auxiliary aim of some embodiments is to make available a production method and a closure system which enables sealing the content while still maintaining the possibility, once the container has been opened, of removably closing the container.

A still further auxiliary aim of some embodiments is to provide the possibility of customising the shape of the container/lid thanks to the possible use of extensible paper.

These and other aims which will more clearly emerge during the course of the following description are substantially attained by a method for realising a container in paper material provided with a lid, and a relative closure system as described in one or more of the accompanying claims.

Further characteristics and advantages will better emerge from the detailed description that follows of a preferred though not exclusive embodiment, of a method for realising containers of paper material and the relative closure lid.

BRIEF DESCRIPTION OF THE DRAWINGS

The description will be made herein below with reference to the accompanying figures of the drawings, provided by way of non-limiting example, in which.

DETAILED DESCRIPTION

Figure 1:
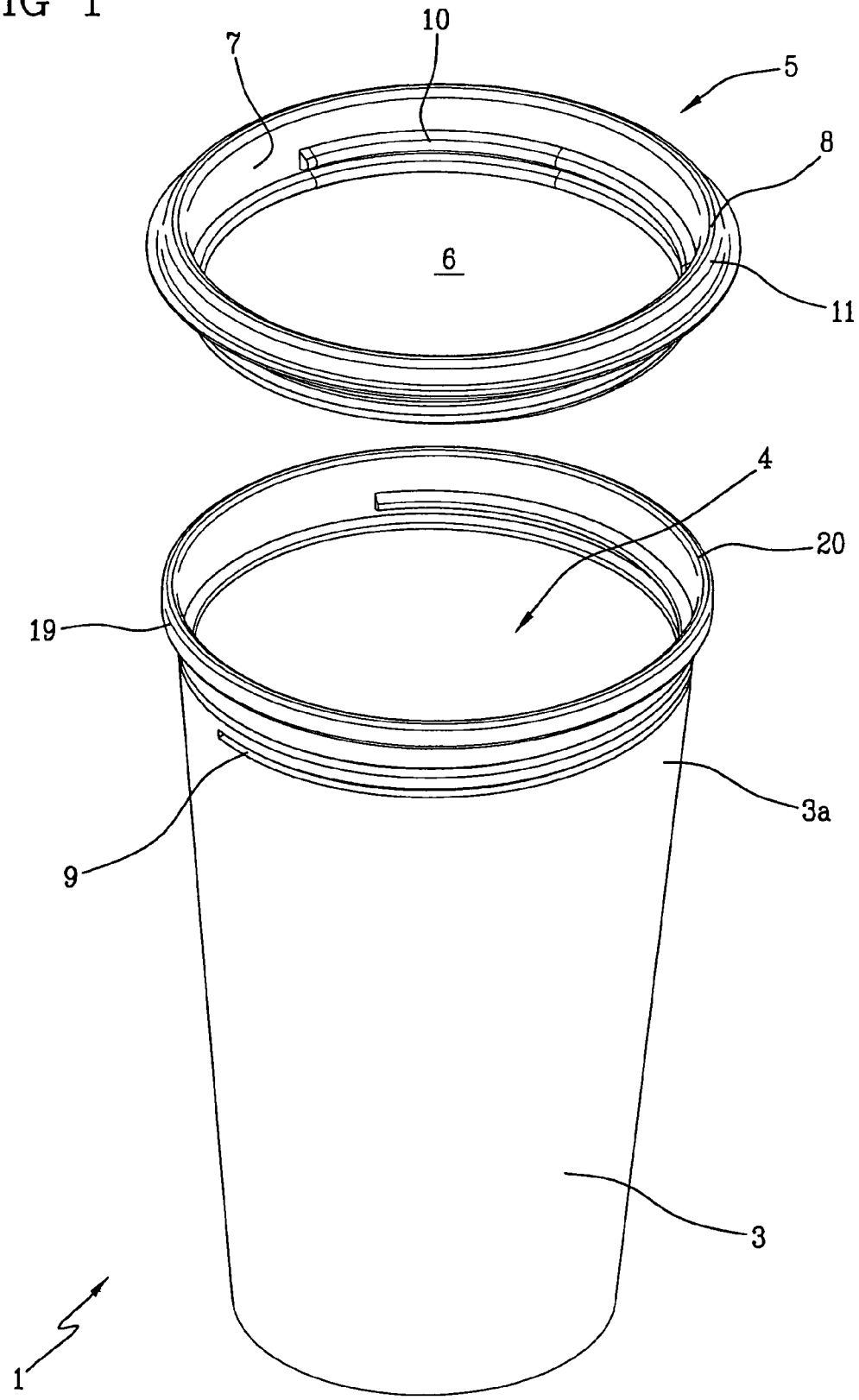
FIGS. 1 and 2 are a perspective and exploded view of a possible embodiment of a paper container obtained using the described method.

With reference to the figures, 1 denotes in its entirety a container made of paper material provided with a relative screwable closure lid 5.

In the illustrated embodiment of FIGS. 1, 2 and 9-11, the container is constituted by a bottom wall 2 to which a lateral wall 3 is constrained, which lateral wall 3 emerges from the bottom 2 such as to complete, in cooperation, a housing chamber 4 for the product to be contained.

In the specific case (not limiting) the product to be contained could be a comestible drink or the like and the container 1 defined by a beaker made of paper material internally clad with a film for food use such as for example a single polyolefin (polythene or polypropylene or another) or coupled with aluminium, EVOH or other barrier layers.

In other terms, the use in general of a paper (normal or extensible) coupled (mechanically) to a polyolefin film guarantees further advantageous aspects to the product, as will be more clearly discussed herein below.

Figure 2:
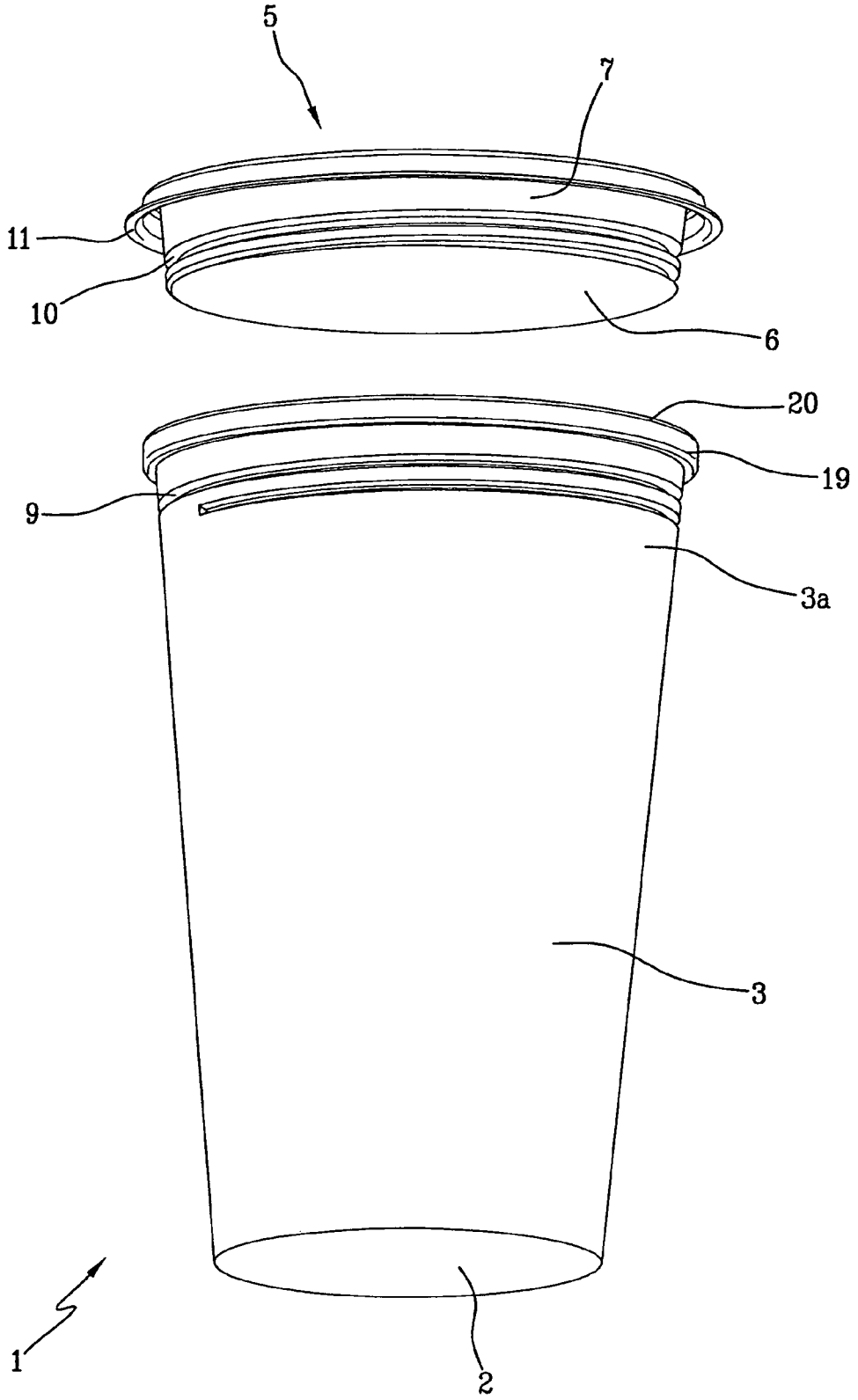
Figure 2A:
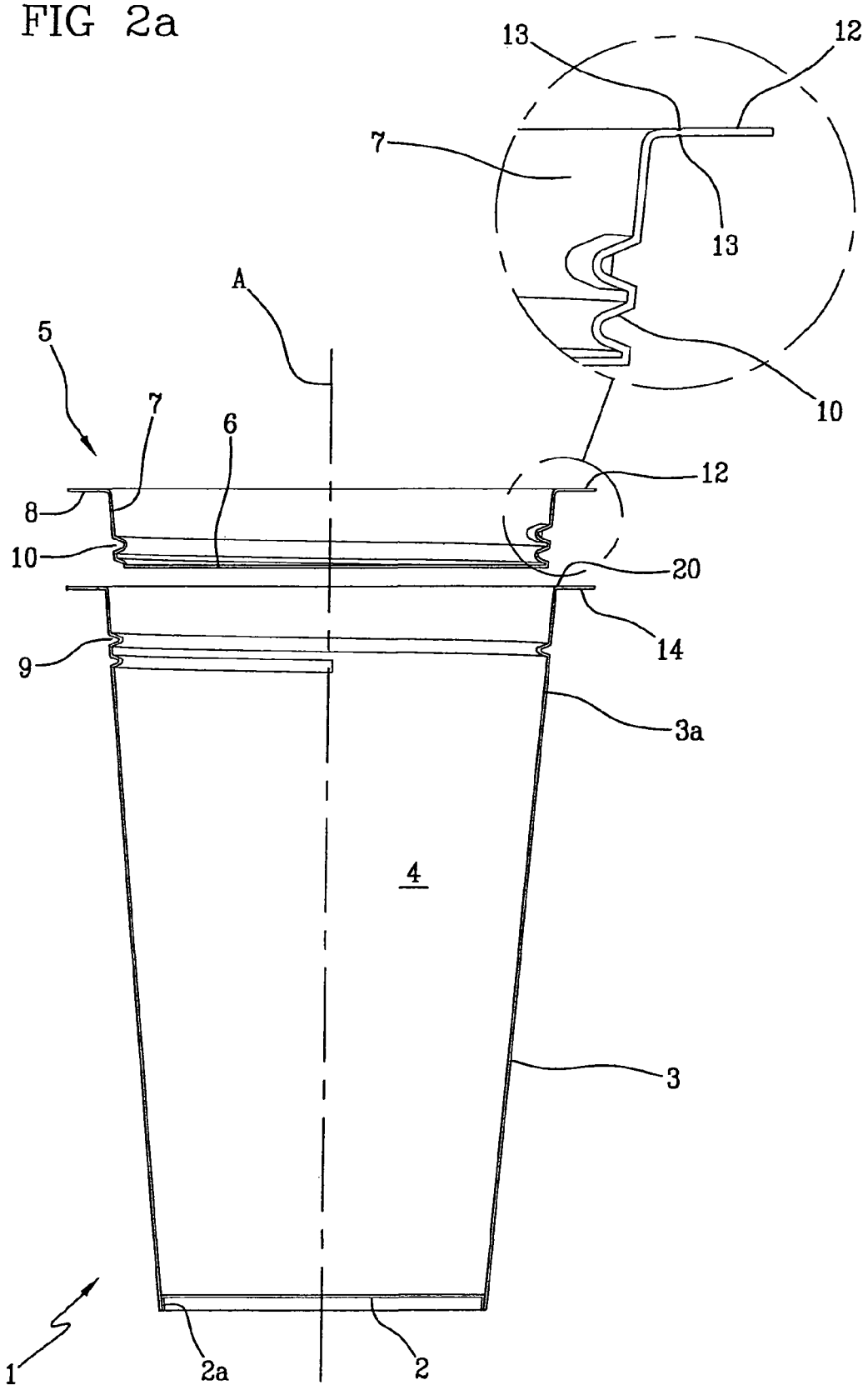
FIG. 2*a* is a section of a possible variant of the container of FIGS. 1 and 2.

The bottom wall 2 exhibits, in section according to a vertical plane, an upturned U-shape of a conventional type such as to define a perimeter edge 2*a* destined to be sealed to the lateral wall 3 (FIGS. 1, 2 and 2*a*).

The lateral wall 3 exhibits a truncoconical shape emerging from the bottom wall 2, which bottom wall 2 has a circular plan, and terminates in a free upper edge 3*a*, defining the lip of the beaker and also substantially circular.

The bottom wall 2 and the lateral wall 3 define, in cooperation, a housing chamber 4 destined to receive the product or products to be contained.

It is entirely evident however that for the aims of the present invention the shape of the container, as well as the fact that the container is realised starting from a single sheet of paper material or from a plurality of sheets, appropriately constrained to one another, is entirely by way of example and irrelevant.

Figure 8:
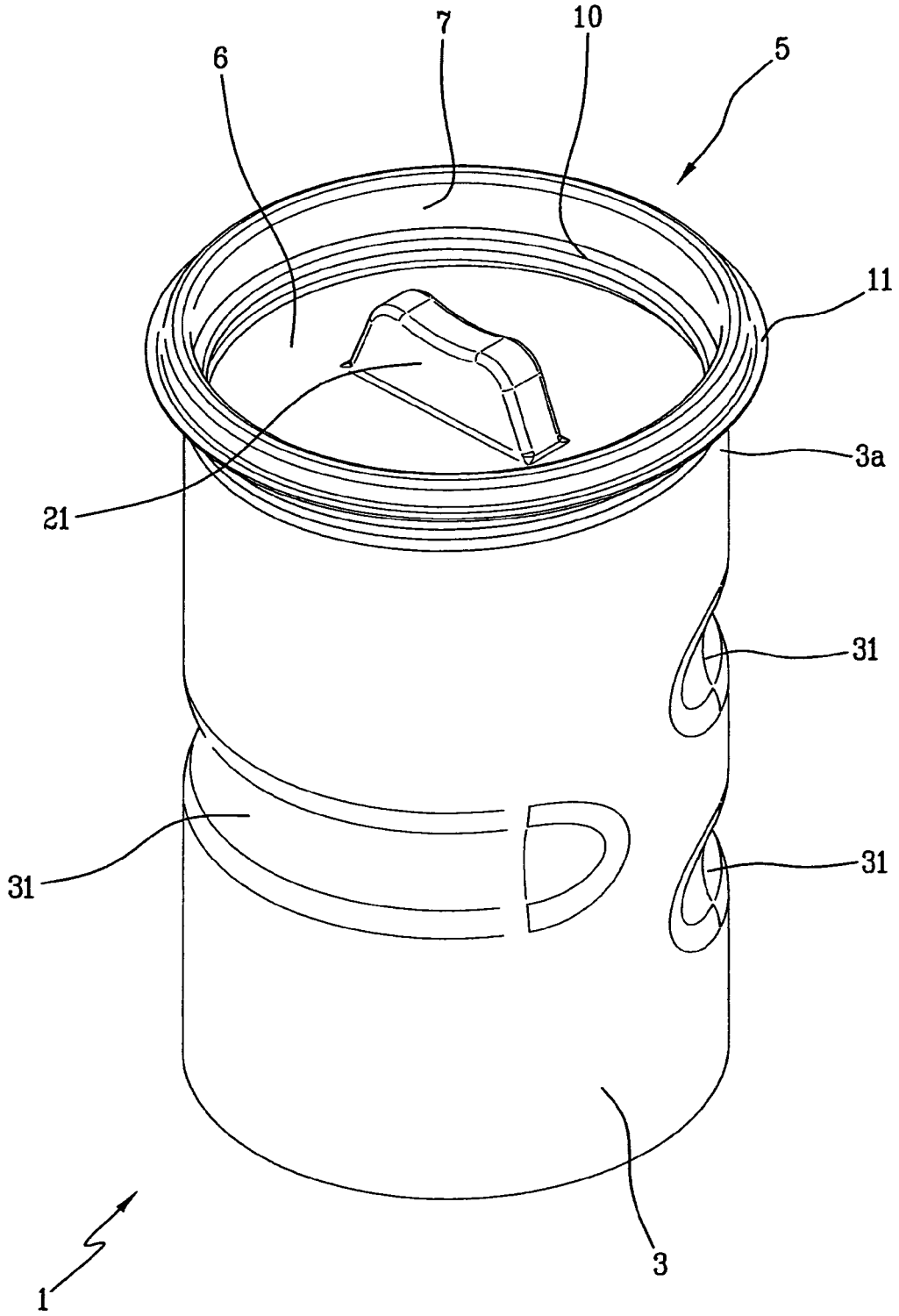
FIG. 8 is a container realised in extensible paper.
Figure 12A:
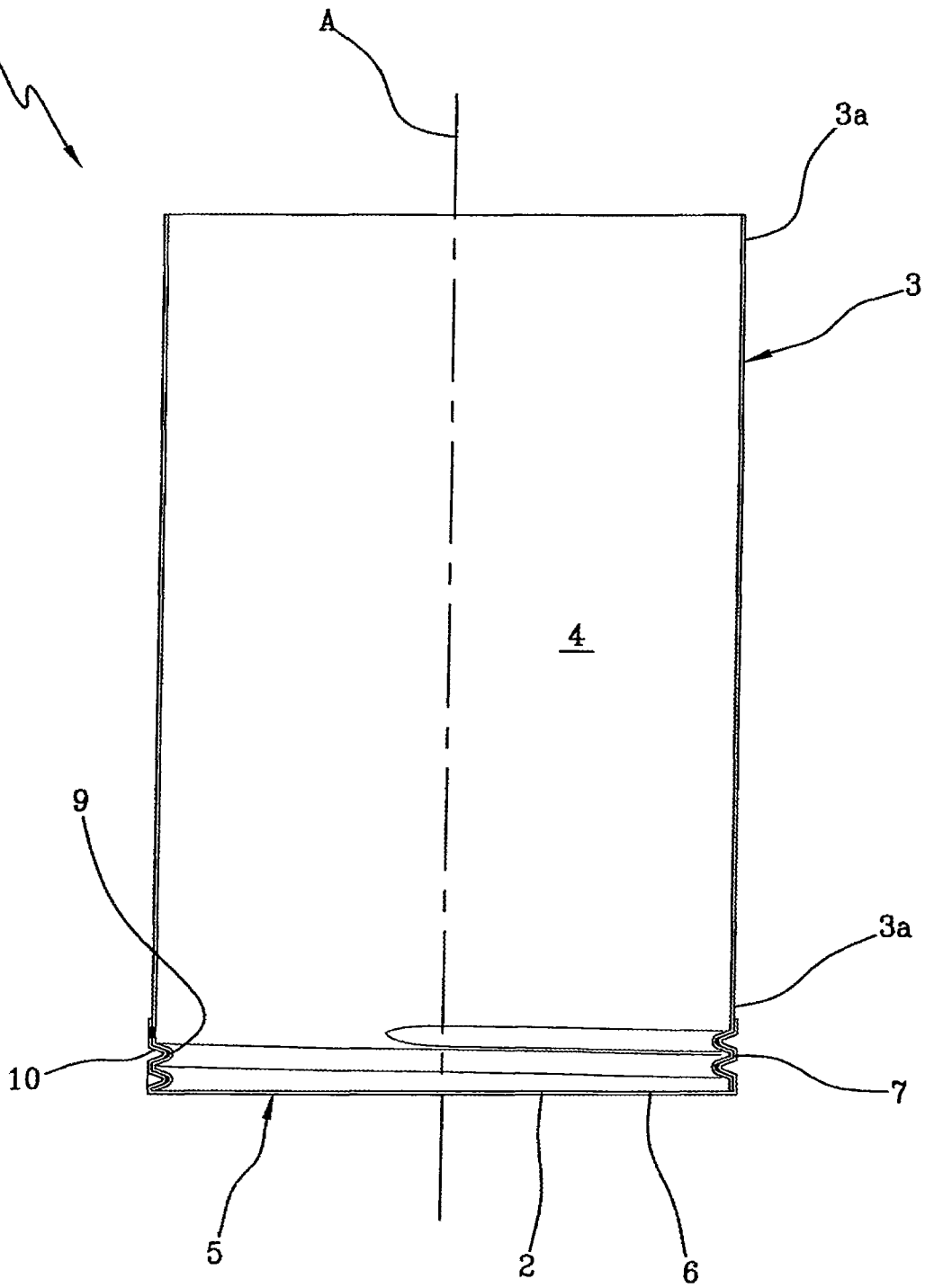
Figure 12B:
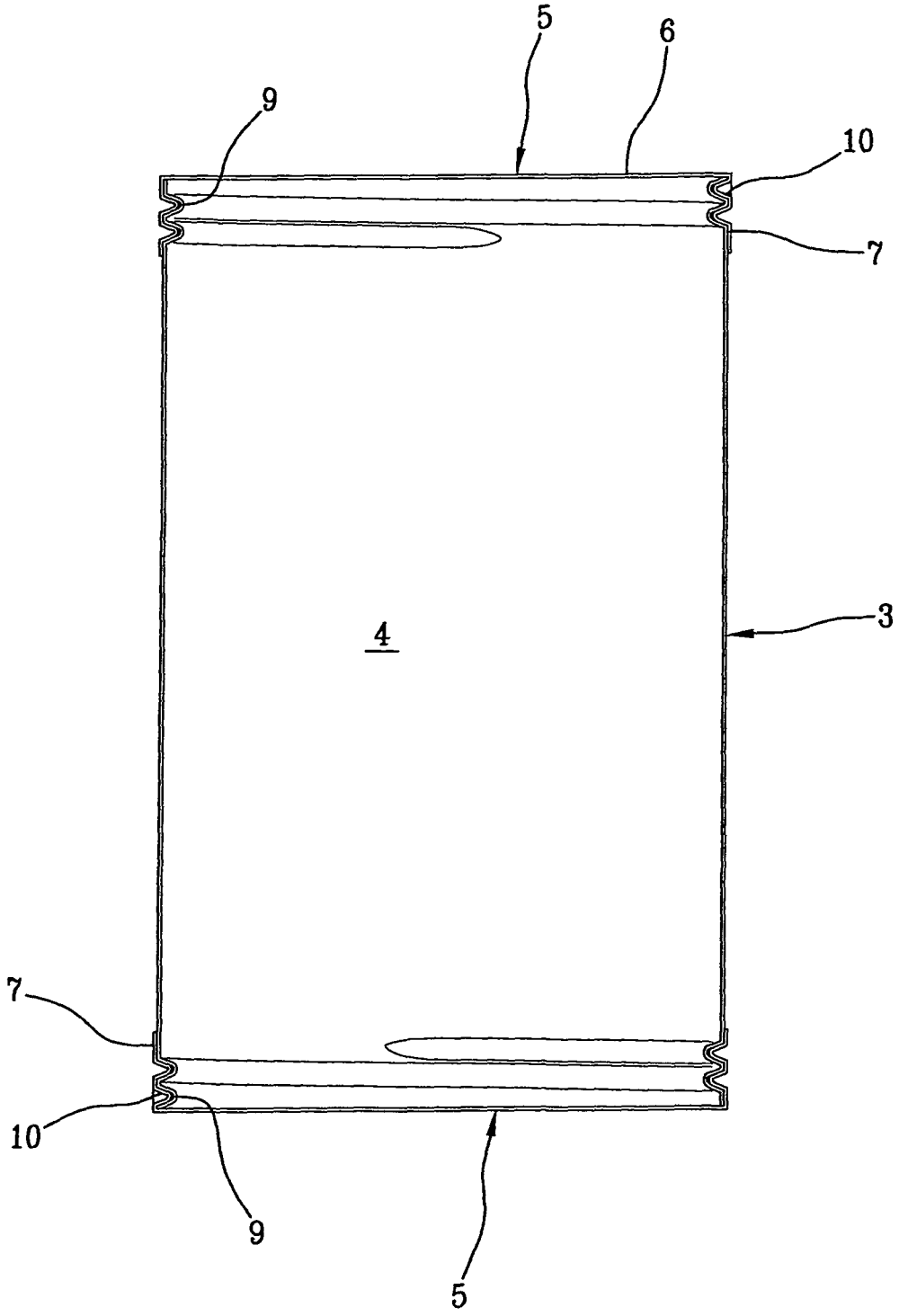

By way of example, the container of FIG. 8 exhibits a substantially cylindrical shape, but with deformations of both the lateral wall 3 and the closure element 5 obtained thanks to the use of extensible paper; the container of FIGS. 12*a* and 12*b* illustrate a container structure 1 which defines the chamber 4 constituted by a cylindrical tubular element provided with two accesses which can be singly removably closed.

As previously mentioned, should they be destined to come into contact with food substances such as drinks, the paper material defining the container will be coated at least on the surface facing towards the container cavity 4 with a special film of plastic material for food use, such as for example a polyolefin. A band is is applied to cover the longitudinal edge of the sheet.

The container also exhibits at least a closure element 5 which has a base wall 6 having a substantially circular shape from which a lateral wall 7 emerges, having for example a truncoconical progression and preferably terminating in an upper fold 8 directed radially and towards the outside of the lateral wall 7.

In the embodiments of FIGS. 1, 2, 2*a*, 8, 9*a*, 9*b*, 9*c*, 10, 10*a*, 10*b* and 11, the closure element 5 is destined, in use, to be housed internally (at least partially) of the container compartment 4 of the container.

In other words, the base 6 has a plan size which is such as to enable it to be inserted internally of the upper portion 3*a* of the lateral wall 3 of the container; in turn the lateral wall 7 of the closure element 5 is substantially complementarily shaped to the mouth zone of the container, and marries the internal surface thereof.

Further, the folded edge 8 of the closure element is destined in use to abut against the free upper edge 20 of the container.

Differently, FIGS. 12*a* and 12*b* show a closure element 5 which couples externally to the lateral wall 3 (i.e. the lateral wall 7 is external to the container chamber 4).

Note that the coupling geometries of the lateral wall 7 of the closure element 5 to the upper portion 3*a* of the lateral wall 3 of the container can be different from those shown by way of example herein.

In other terms, apart from a truncoconical shape which is open in an upwards direction, the portions can for example be perfectly cylindrical (FIGS. 8 and 12) without forsaking the inventive concept of the present invention.

Also note that the container and the closure element can be alternatively or both realised starting from an extensible paper, i.e. paper able to withstand without breaking deformations of greater than 5% (even up to 20%).

In the light of this, complex shapes of the container can be defined, which might exhibit bulges, curved walls or more besides according to the requirements of is the occasion. This in general enables containers to be obtained which have a different shape to the cylindrical or truncoconical shape.

Figure 9A:
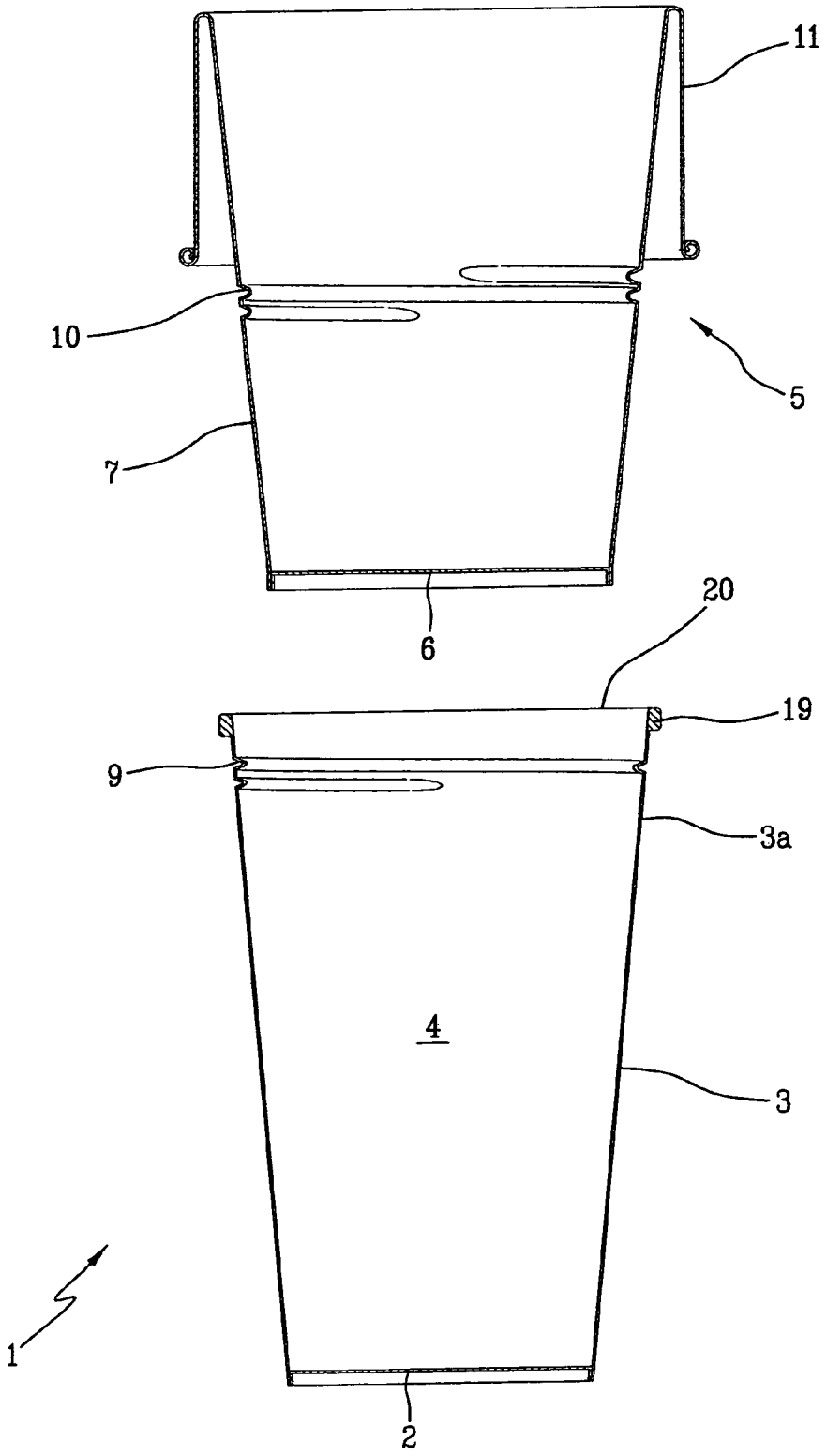
FIGS. 9*a* and 9*b* show the coupling of two containers of which one is the closure element.
Figure 9B:
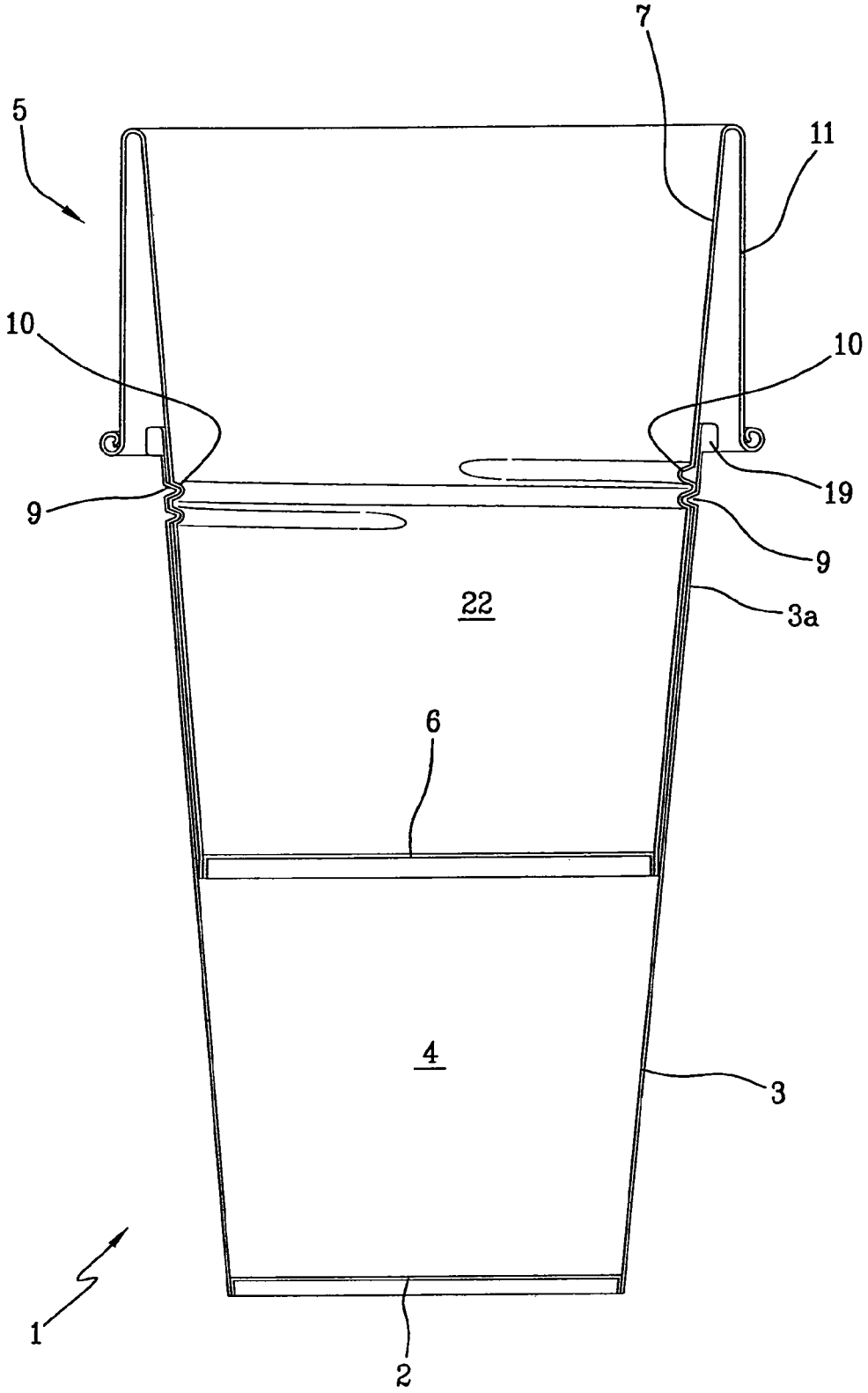
Figure 9C:
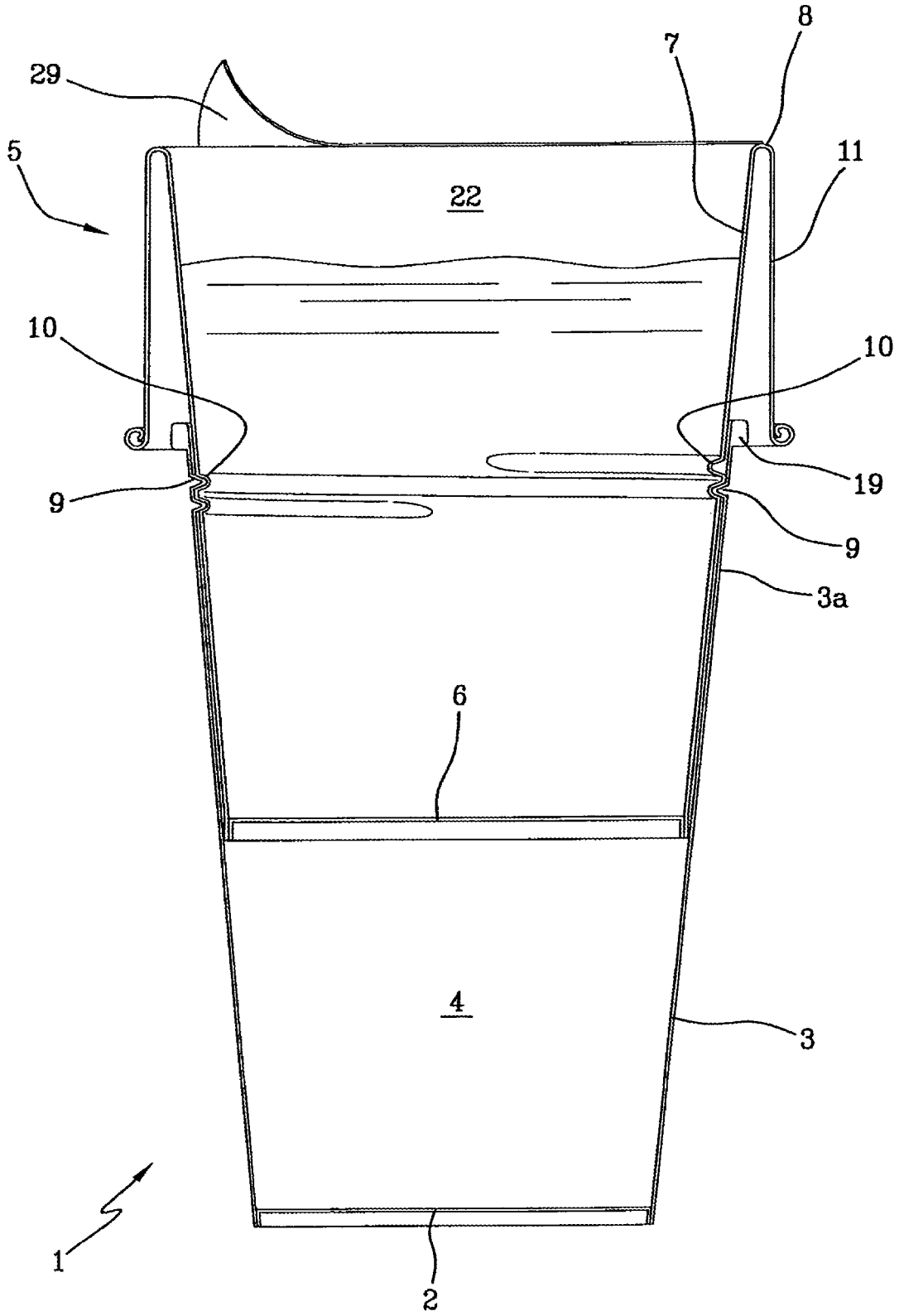
FIG. 9*c* is a variant of the coupled containers of FIGS. 9*a* and 9*b;*

Further, the closure element 5 can be realised starting from a single sheet of flat paper material specially deformed and funnelled (FIGS. 1, 2, 2*a*, 8, 10, 12) or, alternatively, can be formed from several pieces joined to one another (FIGS. 9*a*, 9*b* and 9*c*).

The realisations of the closure element 5 with an extensible paper enables contact surfaces with the container to be conformed substantially flat and, if possible, without pleats or excesses of material which normally are generated by deforming a flat element made of paper material realised starting from normal paper.

The present of substantially flat surfaces, i.e. the absence of pleats due to excess material, can contribute to increasing the seal of the closure element 5 coupled to the container 1, for example sealing of oxygen or liquids.

Further, an improved seal can be realised by obtaining an additional seal by spraying on the desired surface (for example on the closure element) a suitable substance which once solidified (and possibly thermally treated) considerably increases seal against liquids and external agents.

For example the substance might be located such as to be interposed in use between the closure element 5 and the free edge 20 of the container, thus guaranteeing seal over the whole circular perimeter.

Note that the upper portion 3*a* of the lateral wall 3 of the container exhibits a spiral groove 9 for defining a trajectory which is slightly less than two full spiral turns (obviously longer or shorter turns can be equally provided without forsaking the ambit of invention of the present invention).

Correspondingly the closure element 5 exhibits a groove 10, also spiral, destined to marry perfectly to the above-cited groove 9 of the upper portion 3*a* of the lateral wall 3.

The groove 10 is defined at the lateral wall 7 of the closure element 5 such as to enable a coupling by rotation of the container with the closure element 5.

In this way, if the grooves are sufficiently developed, a screw-coupling is achieved by screwing the closure element 5 on the container.

In particular, the arrangement of the spiral ribs is such that in some embodiments, after the screwing-on, the folded edge 8 of the closure element 5 goes to strike against the free upper surface 20 of the lateral wall 3.

The locking force is such as to exert a good pull on the above-cited surfaces such that they guarantee the sealing of the container during the closure stage.

Note that the plastic coating film of the container and the coating of the lid will come into contact in the zone 20, contributing to increasing the fluid seal of the container.

The spiral grooves 9, 10 exhibit an inclination with respect to the vertical which is very contained such as to define an optimum locking force (purely by way of example the angle of inclination of the spiral with respect to the vertical will be comprised between 1 and 15 degrees).

In the first embodiment, shown in FIGS. 1 and 2, the folded edge 8 of the closure element 5 exhibits a portion 11 which extends downwards such as to cover the reinforcing curl 19 of the container, thus improving the aesthetic aspect of the container.

FIG. 8 illustrates a further possible embodiment of a container obtainable with the described method, which evidences the potential supplied by the use of extensible paper.

The illustrated container has, generally speaking, a circular section in a horizontal plane, but though it is made of paper, it can exhibit expansions or recesses, for example in the median zone of the container volume, which would be impossible to achieve with normal paper.

The example shows an ergonomic shaping 31 for receiving a user's fingers; other and different shapes are obviously possible.

At the access opening the threaded closure element 5 perfectly couples to the upper cylindrical portion 3*a* of the lateral wall 3.

The closure element 5 exhibits an expanded deformed zone 21 at the base wall 6 is which defines, for example, a gripping element for facilitating the screwing/unscrewing of the closure element 5.

A further embodiment is illustrated in FIGS. 9*a* and 9*b*, in which a container 1 is shown in the form, for example, of a beaker, to which a closure element 5 is coupled which is in fact defined by a further container.

In particular, the closure element 5 is realised in two parts, exhibiting a lateral wall 7 and a bottom 6 coupled by heat-welding.

Further, the closure element 5 is provided with a folded edge 11 which, apart from having the aesthetic functions as described herein above, also performs the important role of heat insulating the contents, if any, of the closure element 5 such that it is possible to exploit the closure element 5 for the consumption of hot drinks or the like.

In particular FIG. 9*b* shows the containers of FIG. 9*a* in reciprocal coupling conditions.

Figure 10:
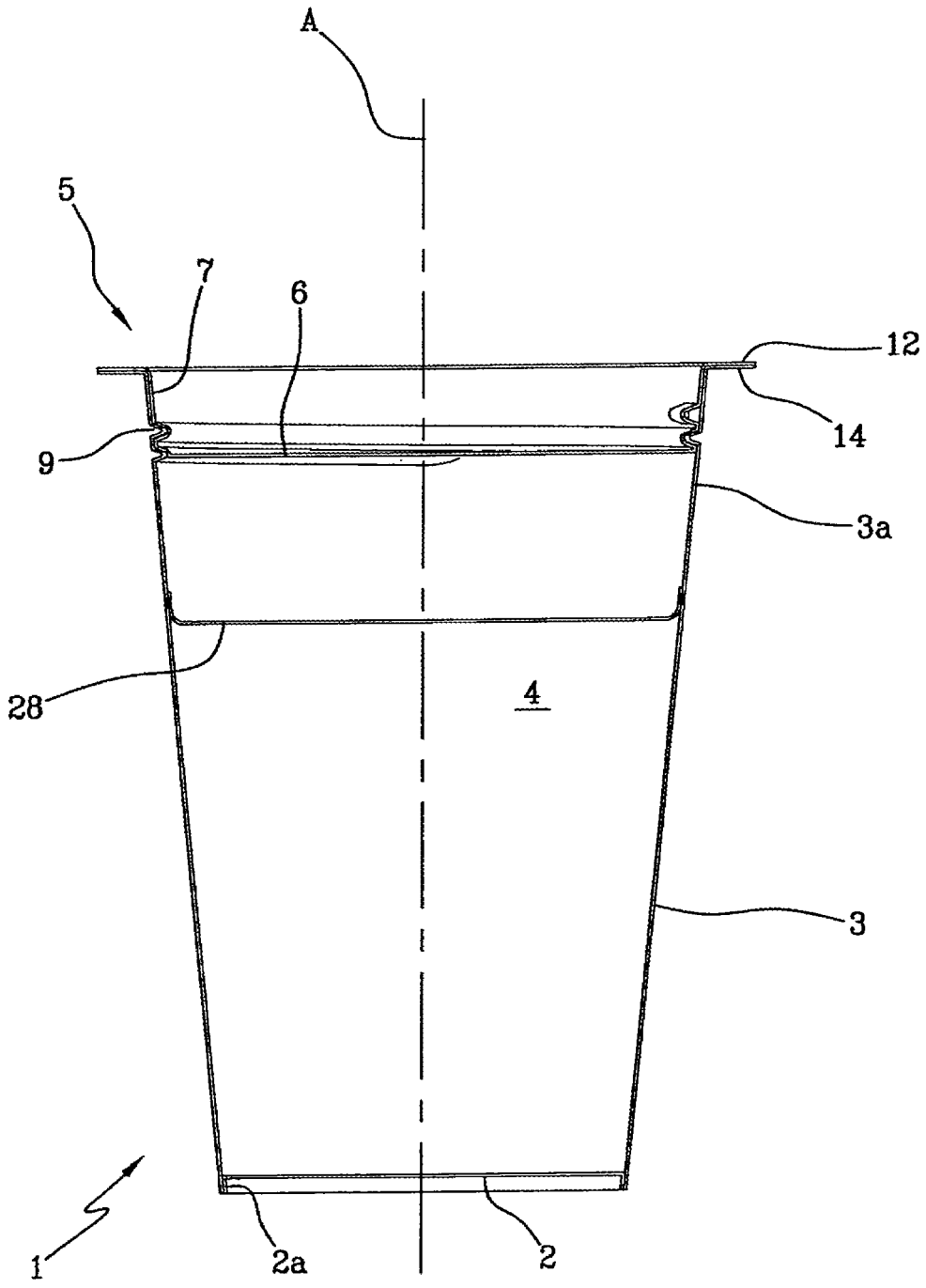
FIGS. 10, 10*a*, 10*b*, 11, 12*a* and 12*b* show further variants of the container obtained with the described method.
Figure 10A:
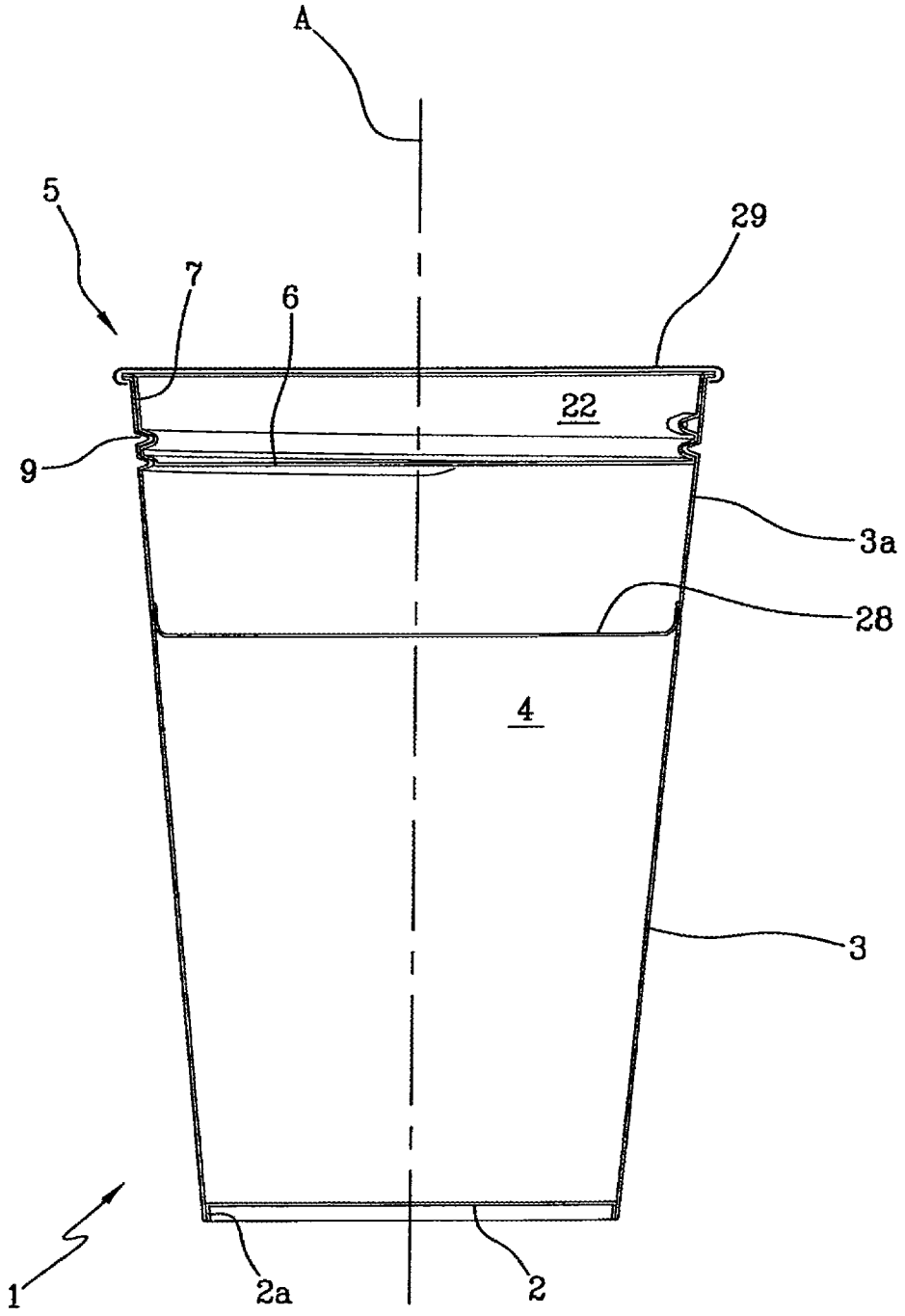

As can be seen in this situation a housing chamber 4 is defined internally of the closed container 1 by the closure element 5, but there is also a further containing volume 22 (present, though of smaller entity, also in other embodiments, for example in FIGS. 1 and 10) defined by the closure element 5.

Also, in the embodiment of FIG. 9*c*, the volume 22 defined between the lateral wall 7 and the base 6 of the closure element 5 is used for containing a further product (for example a liquid as shown), which might be different with respect to the one contained in the chamber 4 of the container 1.

Note also the presence of a sealing element 29 defined by a closure film applied superiorly of the element 5 (and subsequently separable therefrom) such as to realise a seal to external agents also for the containing volume 22 defined in the closure element 5.

In this way it is possible to realise container destined to house two different products, one in the main chamber 4, the other in the volume 22 of the closure element 5.

Merely by way of example, the containing chamber 4 can house a paint, while is the chamber of the closure element 5 can house a second component to be added at moment of use (a bi-component mixture either for food or non-food use, or medicinal use).

The embodiment of FIG. 2*a* is different from the others in that the folded edge 8 of the covering element exhibits an end portion 12 destined to define a flat circular surface (inclined or not with respect to the horizontal).

The container 1 also exhibits, at the upper edge of the lateral wall 3, an edge 14 folded externalwise and arranged in closed conditions of the closure element 5 at the above-cited flat edge 12.

In this way the two facing surfaces of the edge portions 12, 14 substantially touch and can be welded (at one or more points) to one another, defining, when completely joined, a sealed closure condition of the whole.

A further sealing possibility, when both circumferential portions 12 and 14 are associated, can be the application of a plastic ring (which could be applied at the moment of packaging by injection moulding) which will then be removed on the act of opening the package.

The presence of a waterproofing layer (polythene or the like), which layer is coupled to the paper or extensible paper, obviously guarantees the possibility both to contain liquids or the like and the possibility welding one or more parts of container and lid to one another.

Weakened lines 13 can then be advantageously realised, either on one or on both surfaces (or both, as has been shown) the surfaces of the previously-defined flat portions, especially in a zone closed to the upper edge of the container such as to make available a facilitated opening of the container.

FIG. 10 exhibits a further embodiment, in which the container 1 is provided with a special sealing element 28 which is applied internally to the lateral wall 3 in order to insulate and seal the containing chamber 4 (or at least at a lower portion).

In this way the product contained in the chamber 4 cannot exit therefrom, nor can the outside air penetrate such as to guarantee optimal conservation of the is product.

As in the case of FIG. 2*a* there can be the presence of a further sealing between the flat portions 12 and 14 should it be intended to place a further product (for example a free gift), internally of the containing chamber 4, but in the portion above the sealing element 28.

The embodiment of claim 10a shows an alternative adoption of a sealing element 29 of the volume 22 of the closure element 5 which exploits the use of a heat-retractable plastic film to define an excellent closure of the chamber, even possibly fluid-sealed.

Further worthy of note is that it is possible not only to realise a removable coupling with heat-retractable elements, but it will also be possible to define couplings (which though guaranteeing optimal seal to external air and therefore oxygen) that can be simply separated by peeling and not by tearing away of the whole portion 29 (such as for example in FIG. 9*c*).

Thus a perfect seal of the container system 1 plus the closure element 5 is guaranteed to external agents, once the circular closure strip or the film are removed, though opening and closing is still possible by means of the threaded element which engages on the corresponding threading of the lateral wall of the container.

In this way a container can be sold while guaranteeing the sterility/conservation of the product contained therein, and enabling the user, once the container has been opened, to continue to open and close it.

It is clear that, though not necessary, the use of an extensible paper enables easier and better sealing of surfaces which can be substantially flat though being made by deformation, drawing, compressed air, vacuum or a combination thereof.

Figure 10B:
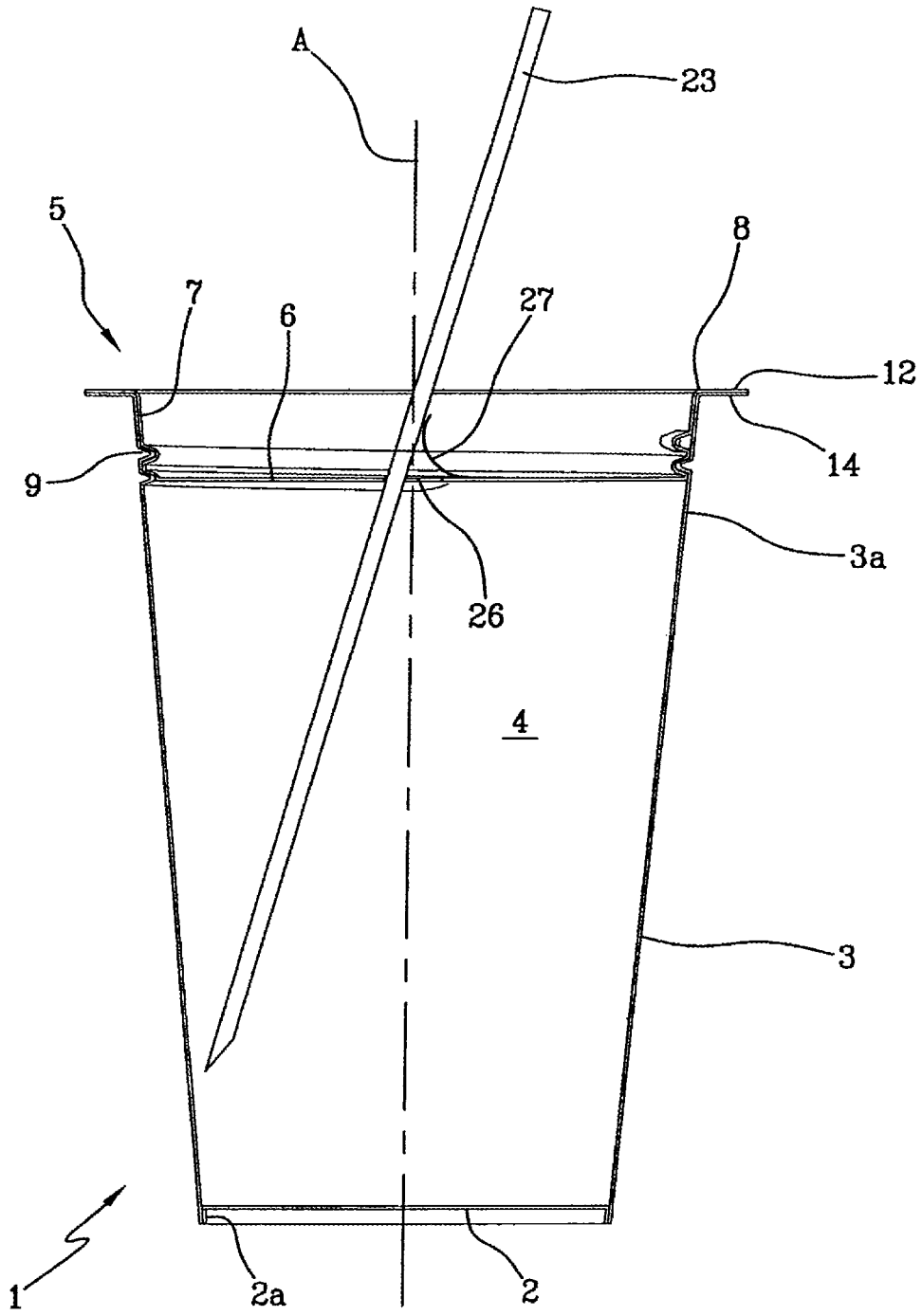

The embodiment of FIG. 10*b* has a further variant of a container structure in which the closure element 5 exhibits, at the base wall 6, an access 26 which is suitably closed and sealed by means of a respective sealing body 27, for example a plastic or aluminium film which is specially coupled such as to close the access 26.

Once the sealing body 27 has been removed a passage is defined between the outside environment and the containing chamber 4 through which, for example, a straw 23 can be inserted in order for a user to access the drink, or for other purposes.

In a further embodiment which is not illustrated, the access 26 can be defined by a plurality of small perforations and can be originally closed by means of the sealing body 27.

Once the sealing body 27 has been removed, a granular product contained in the containing chamber 4 (salt, oregano, a condiment or another product) can be dispensed.

Figure 11:
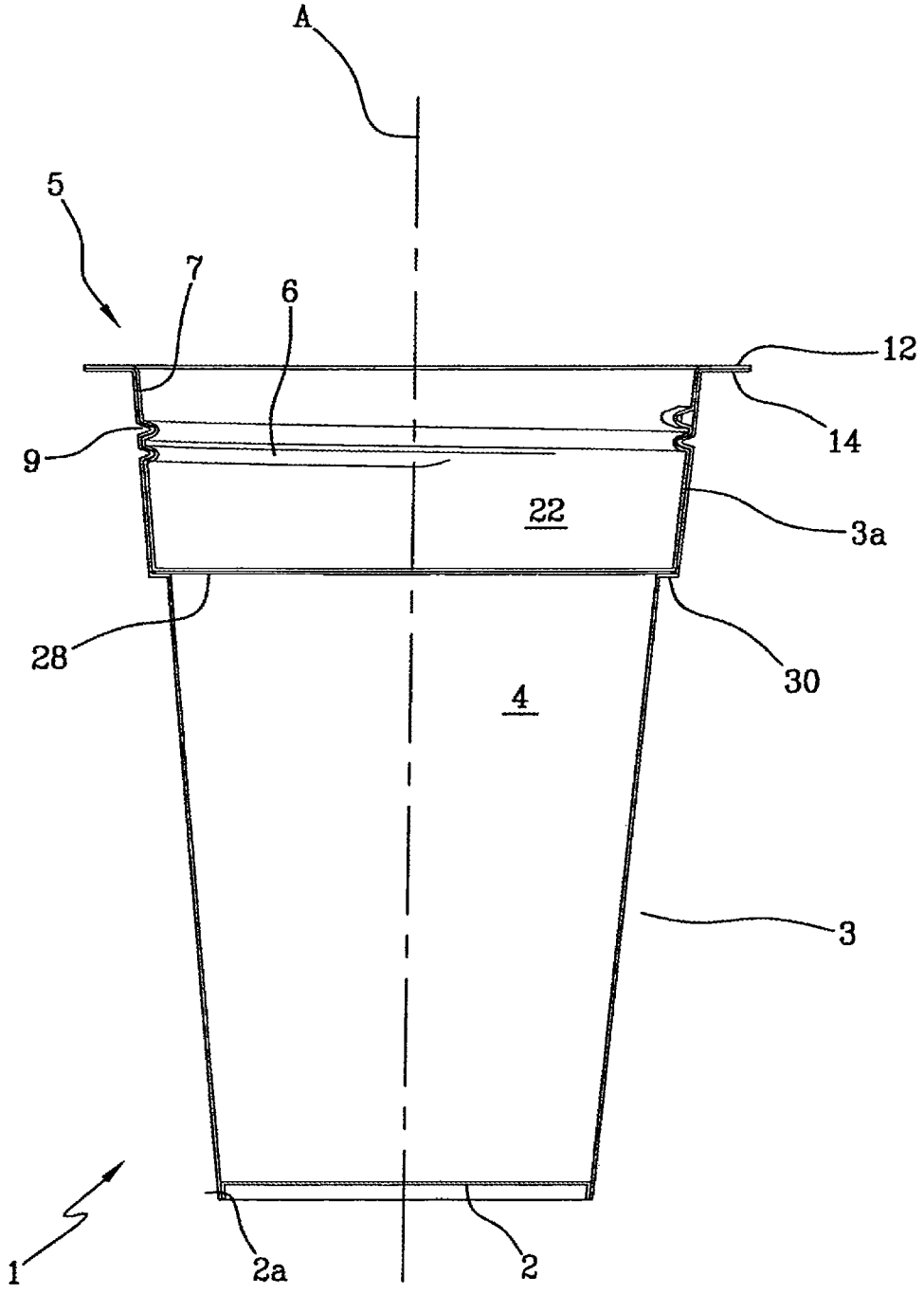

The embodiment of FIG. 11 is an advantageous embodiment for association of the sealing element 28 internally of the lateral wall 3.

The container 1 illustrated, when realised with extensible paper, can be deformed such as to exhibit a special annular abutting surface 30 which can enable an easier coupling of a sealing film 28.

In particular, the sealing element 28 will be applied, using for example a punch, and will guarantee sealing at the portion of annular abutting surface 30.

Note also that the abutting surface 30 can constitute the end run for the closure element 5 such as to avoid screwing operations beyond the end run of the threads.

Obviously the volume 22 too can be closed with one or more of the previously-described methods.

Finally the FIGS. 12*a* and 12*b* exhibit two slightly different embodiments with respect to the ones already described herein.

The container of FIG. 12*a* is constituted by a substantially circular tubular structure 1, in which the lateral wall 3 exhibits a double access at an upper portion and a lower portion.

One, the other or both the accesses can be closed by duly threaded closure elements 5.

In particular, the embodiment of FIG. 12*a* illustrates a closure element 5 which defines the bottom 2 of the container.

Further, the lateral wall 7 of the closure element 5 is arranged, during use conditions of the container, externally of the lateral wall 3.

FIG. 12*b* illustrates a container 1 provided with two closure elements 5, for closing both accesses to the chamber 4.

In this case too the lateral wall 7 of both the closure elements 5 is arranged externally of the lateral wall 3.

It is thus possible to realise the container of FIG. 12*b* with one, the other or both the closure elements which exhibit the lateral wall 7 arranged internally of the containing chamber 4 and the lateral wall 3 (as in the case of FIG. 1).

In a further embodiment, not illustrated, with the thread fashioned in the lower edge, the truncoconical structure can be flared contrarily to the conicity thereof at the lower zone (obviously this can be realised only with use of extensible paper) and, for example, a beaker can be constructed having an upturned-conical pedestal for a cup having a much stabler base.

Still from the structural point of view, the thread 9 realised on the upper portion of the container and the thread realised on the closure element are defined by recesses which face towards the inside of the container, i.e. towards the inside of the lateral wall 7 of the closure element (facing towards the axis A of the container).

In other words, with respect to the undeformed condition of the lateral wall 3, or the lateral wall 7, the threads 9, 10 emerge towards the inside of the containing chamber 4, i.e. towards the inside of the circular base of the closure element 5.

The ribs/deformations which each define threads, both on the closure element 5 and on the lateral wall 3, are continuous, i.e. they do not exhibit interruptions in the three-dimensional development thereof. In some embodiments (not illustrated) a coupling by rotation of the bayonet type can be comprised between the container and the closure element.

With reference to the above, figures from 3 to 7 illustrate the various operating configurations of an apparatus for controlled deformation of the container 1 and the closure element 5 with the aim of realising the threading operations on these components.

Figure 7:
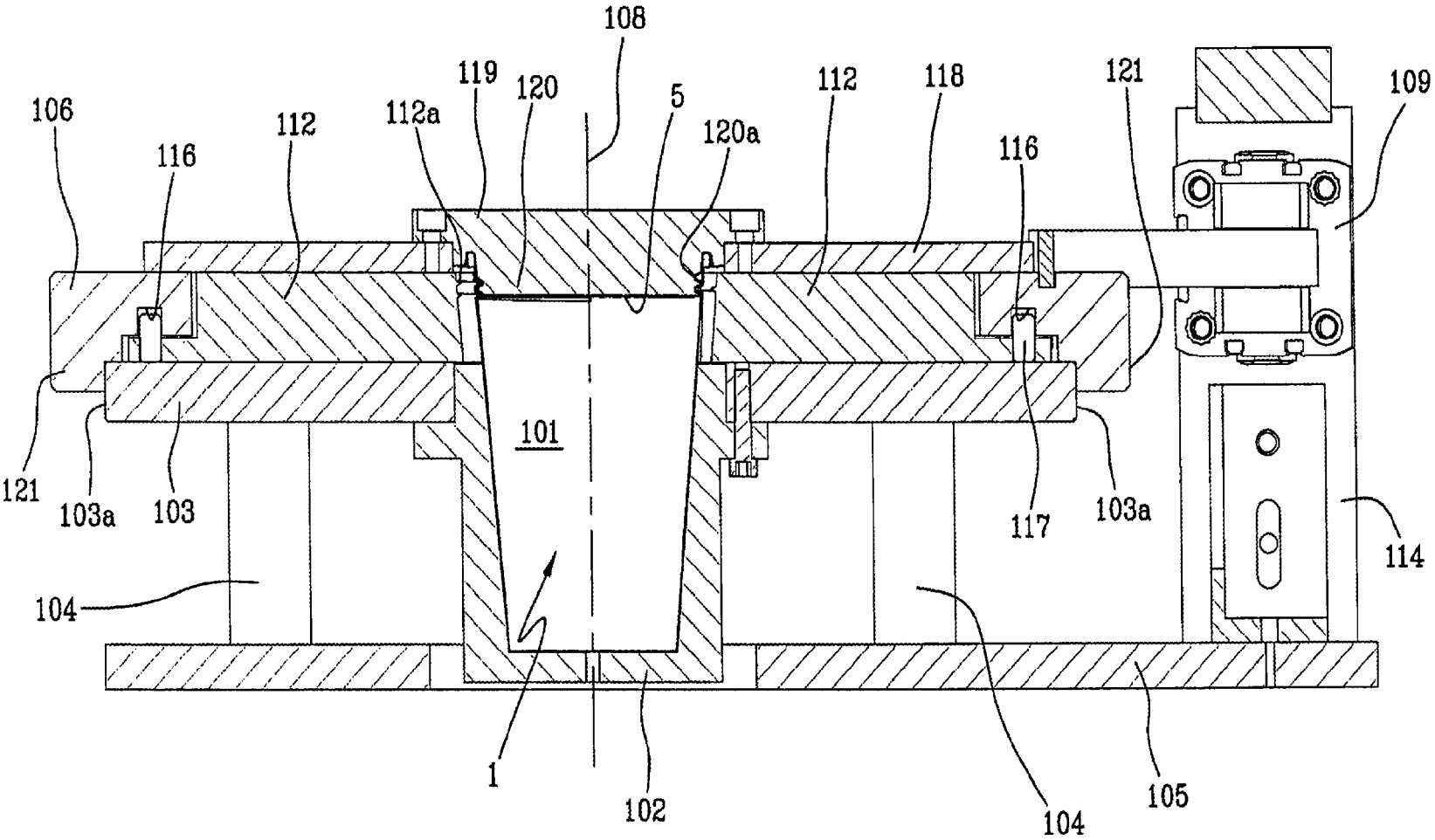

FIG. 7, for example, shows the presence of a containing structure 102 (optional) which defines internally thereof a housing seating 101 for the container 1.

In particular, the containing structure will be substantially complementarily shaped to the lateral wall 3 and the base 2 of the container, receiving it restingly during the working stages.

By way of example, the container could be retained by means of a depression applied at the bottom of the container.

Looking again at FIG. 7, the containing structure 102 is rigidly constrained to a fixed platform 103 having a substantially circular shape, exhibiting a lateral surface 103*a* destined to define a guide for further parts of the apparatus, as will be more fully explained herein below.

The fixed platform 103 is supported by a plurality of uprights 104 in turn borne by a support plate 105.

A mobile body 106 is also present, which rests on and is supported by the fixed platform 103 to which it further couples by means of a folded flange 121 which is guide by the lateral surface 103*a* such that the mobile body 106 can rotate about a central vertical development axis 108 in relation to the fixed platform 103.

With the aim of moving the mobile body 106 in rotation, or more precisely in oscillation, about the vertical axis 108, activating means 107 are also comprised. The activating means 107 can be of various nature and in the illustrated embodiment are constituted by a hydraulic or pneumatic activation 109 able to move an arm 110 to and fro, a drawing element 111 being hinged by means of a vertical pivot to the arm 110.

The drawing element 111 exhibits an end which is constrained to the mobile body 106, and another end is hinged to the arm 110.

In this way the to-and-fro motion defined by the hydraulic/pneumatic activation 109 is transformed into a rotary oscillating motion on the mobile body 106.

Figure 3:
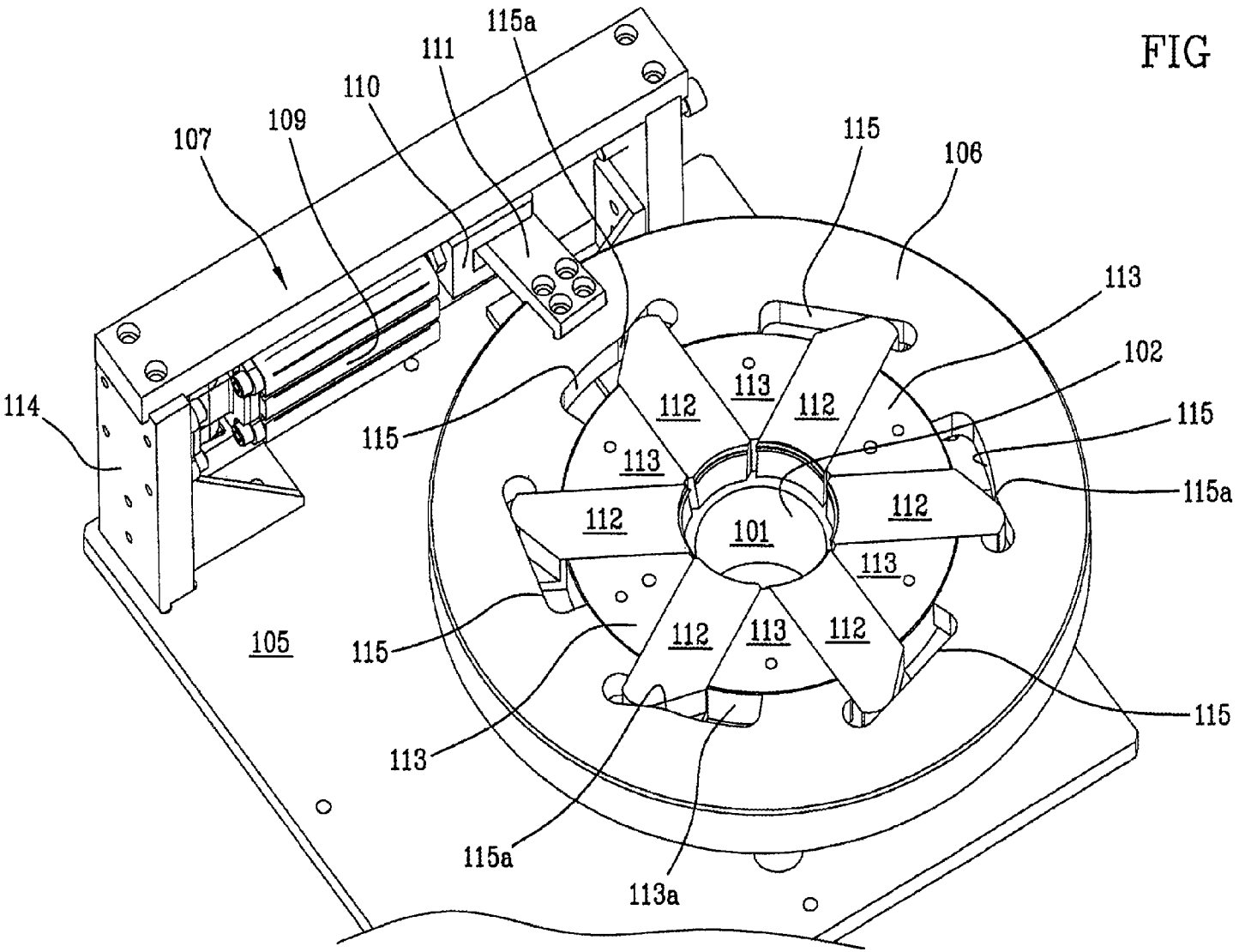
FIGS. 3 to 5 illustrate a schematic view of a tool for realising threading on the lid and container of some of the described embodiments, in various operating configurations.
Figure 4:
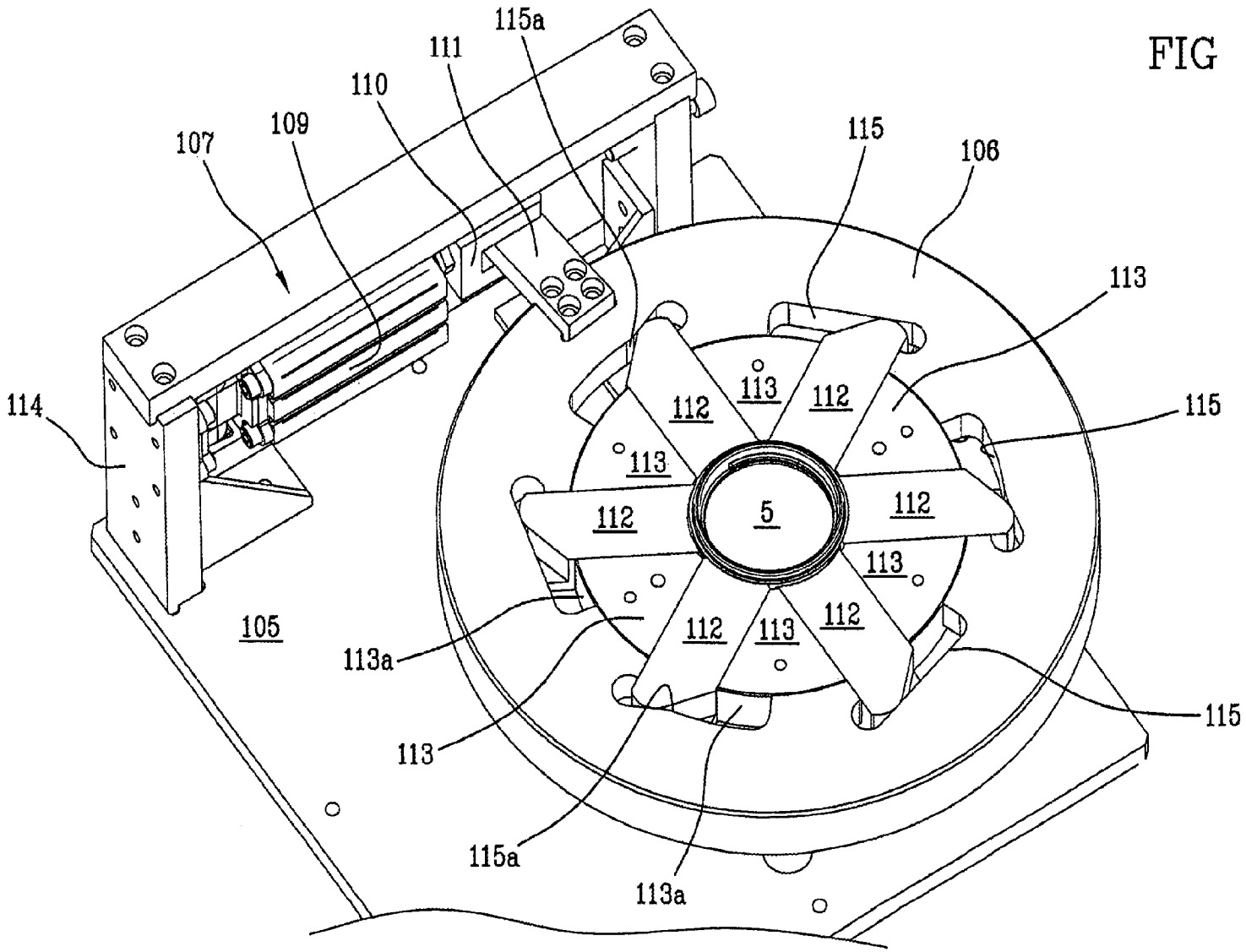

FIG. 3 illustrates how the mobile body 106 exhibits a central seating developing in a circular fashion and a plurality of appropriately-shaped grooved is guides 115.

A plurality of mobile deforming organs 112 are arranged internally of the central seating, among which a plurality of fixed circular sectors 113 are interposed.

The coupling between the mobile organs 112 and the circular sectors 113 is such that the mobile organs maintain a degree of sliding liberty in a radial direction towards the central and vertical axis 108.

An external end of the mobile deforming organs 112 is coupled to the grooved guides, such that a partial rotation of the mobile body 106 in one or another direction leads to corresponding nearing/distancing translations to the central axis 108 of each of the mobile bodies 112.

Importantly, the grooved guides 115 have different shapes such as to define movement times and speed of movement of the mobile organs 112 that are different.

The illustrated embodiment (not limiting) shows six mobile organs 112 intervalled by six circular sectors 113.

Three grooved guides 115 (alternated with the other three guides 115) exhibit a shape having recessed portions 115*a* such that the rotation of the mobile body 106 is accompanied by a translation of the respective mobile organs 112 which translation occurs before that of the mobile organs 112 inserted and coupled to the grooved guides without the recessed portions 115*a*.

In this way, during the locking operations of the mobile organs 112 to the container, three of them which are not contiguous are made to enter into contact with the container before the other three, thus ensuring optimal closure with no interference.

The section of FIG. 7 shows that each of the mobile organs 112, apart from being guided by the guides 115, is also further moved by means of coupling pivots 117 coupled to further guides 116.

The above guarantees precise to-and-fro radial movement of the mobile organs 112 without sticking.

The sections of the represented apparatus illustrate two additional components which have been removed in the perspective view in order to simplify understanding of the functioning of the apparatus.

In particular, still with reference to FIG. 7, note the presence of an upper plate 118 destined to pack the previously-described structure, preventing de-alignment of the parts in motion (i.e. ensuring the mobility thereof in the horizontal plane).

Also present is a counter-die 119 positioned superiorly of the device and coupled to the upper plate.

The counter-die 119 is positioned at the housing seating of the container 101 such that a shaped portion 120 thereof provided on the external surface of respective gullies 120*a* is (under functioning conditions of the device) at least partially inserted in the closure element 5.

Each of the mobile organs 112 is provided on an internal end thereof with ribs 112*a* substantially complementarily shaped and predisposed to cooperate with the gullies 120*a*.

Figure 6:
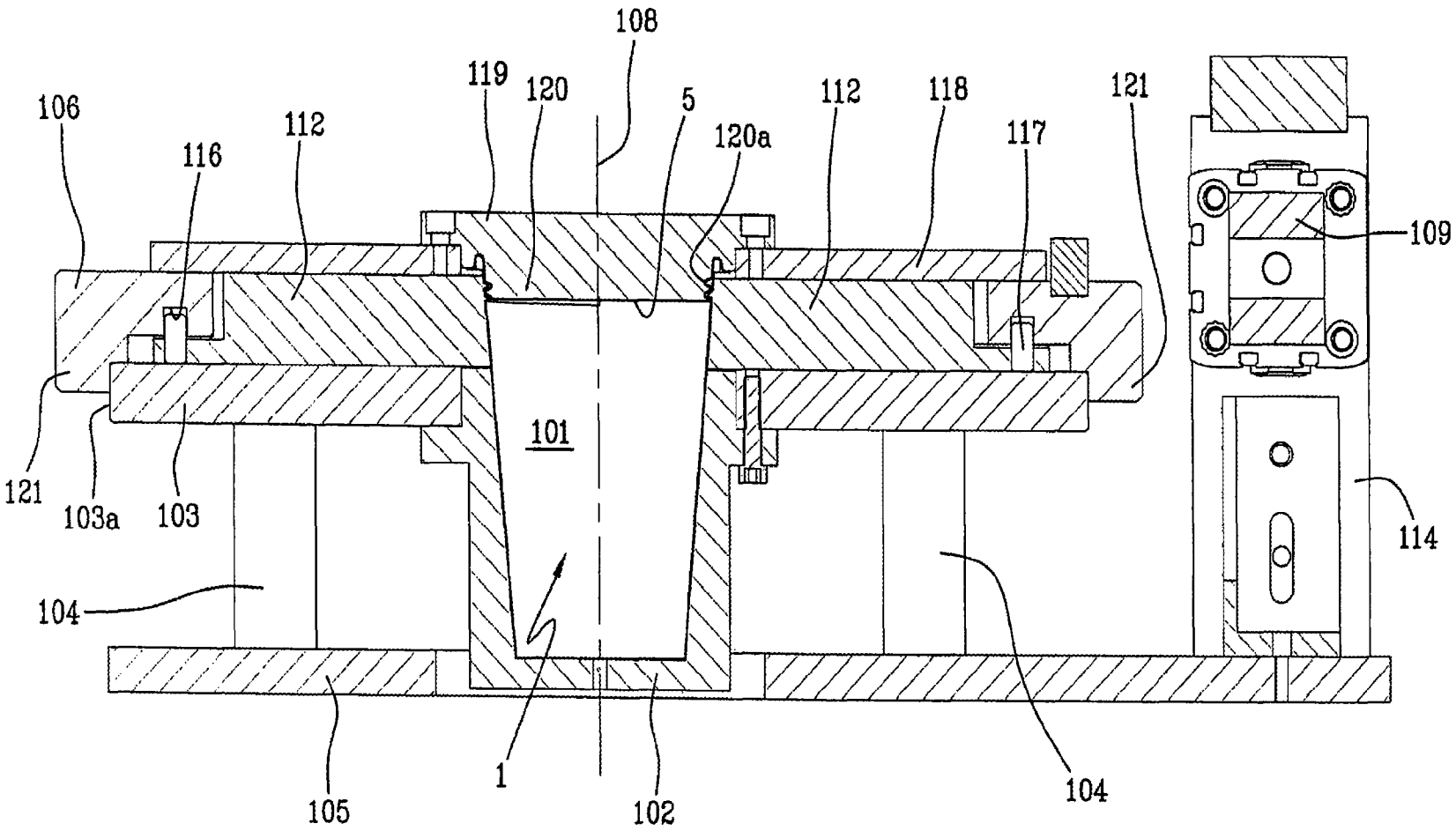
FIGS. 6 and 7 show two sections of the apparatus of FIG. 3 in two different operating configurations.
Figure 6A:
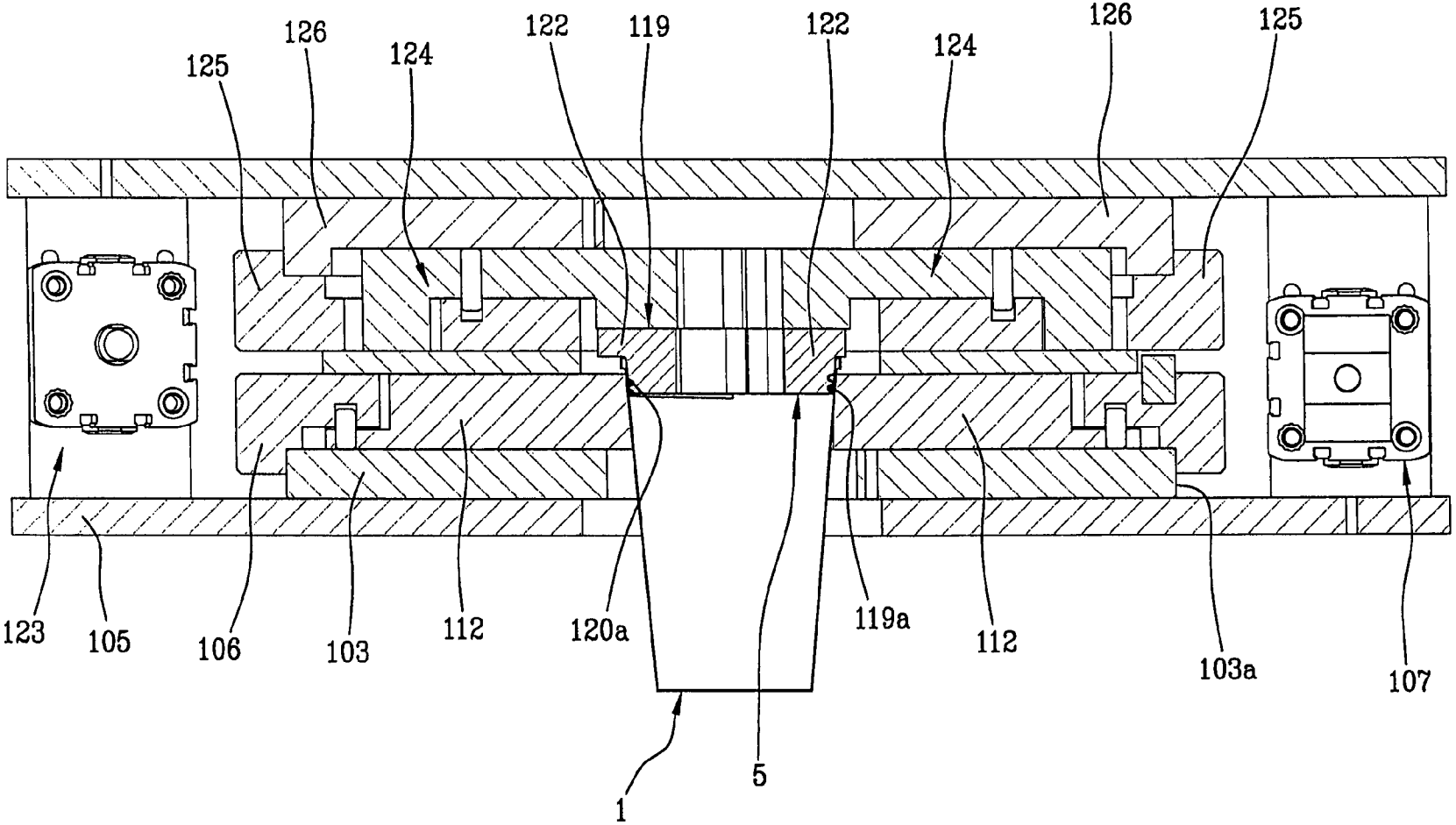
FIGS. 6*a* and 7*a* show two sections of the apparatus of FIG. 3 in an advantageous variant.

A further embodiment of the apparatus for realising the screw-couplings on the container 1 and the closure element 5 is shown in the sections of FIG. 6*a* (closed dies) and 7*a* (open dies).

With respect to the apparatus illustrated in FIG. 7, note the presence of a more complex counter-die 119 defined by expandable mobile portions 122 exhibiting the gullies 120*a* destined to cooperate with the ribs 119*a*.

Figure 7A:
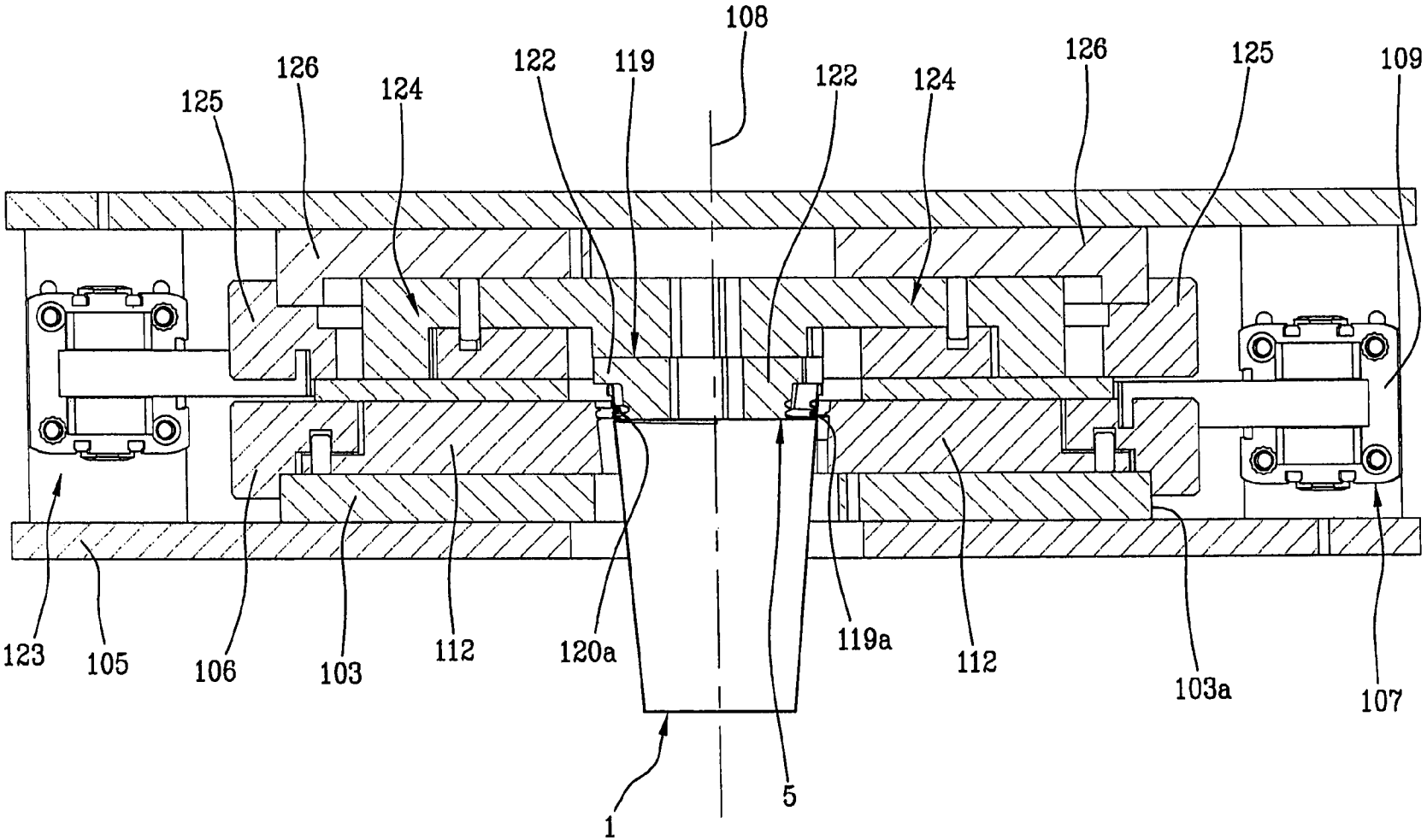

The presence of the expandable sectors 122 is necessary where it is desired to optimise the extraction from the apparatus of the container 1 and the relative closure element 5 once the threading has been realised thereon (FIG. 7*a*).

In the rest condition the sectors 122 of the counter-die 119 exhibiting the gullies 120*a* are retracted towards the central axis 108 of the apparatus and thus do not interfere with the ribs 9, 10 just created on the container 1 and the closure element 5.

In the passage from the rest condition to the working position of the device, not is only do the mobile organs 112 near the container, deforming the prescribed portions thereof, but also the expandable internal sectors 122 of the counter-die 119 enter into contact with the internal surface of the closure element 5 in such a way as to be able to cooperate with the corresponding ribs 119*a* as previously described.

Once the deformation operation has been completed, not only do the mobile organs 112 distance from the lateral walls 3, 7, the expandable internal portions 122 also retract towards the axis of development 108 of the containing structure 102, freeing the threads 9, 10 that have just been realised and enabling a simple extraction.

In the configuration of FIG. 7, the extraction of the counter-die 119 is done by rotation of the counter-die 119 about the axis 108.

In more detail, the embodiment of FIGS. 6*a* and 7*a* is notably without a containing structure 102 which embraces the whole container (as in FIG. 7)

Further activating means 123 are comprised, which are substantially identical to the ones described herein above, but which are arranged on an opposite side with respect to the support frame of the machine.

The means 123 move return organs 124 such as to synchronise the movement of the expandable sectors 122 with those of the mobile organs 112, as shown in the sequence between FIGS. 6*a* and 7*a*.

As for the mobile organs, the activating means 123 set in oscillating rotation a disc 125 on a fixed circular body 126. Appropriate cam couplings transform the oscillating rotary motion into a radial expanding/retracting movement of the sectors 122.

In this way a work position is generated of both the mobile organs 112 and the internal expandable sectors 122 which cooperate and deform the lateral walls of the closure element 5 and the container 1 (FIG. 6*a*); in a second operating stage, the synchronised movement of the movement means 107 and the further movement means 123 distance the mobile organs 112 from the lateral wall and also the expandable sectors 122 from the lateral wall but towards the axis 108 (the position shown in FIG. 7*a*).

As can be seen in FIG. 7*a*, the closed container realised can be removed with a simple extraction by translation, its no longer being necessary to perform any type of relative rotation between the container and the apparatus realising it.

It is clear that other embodiments of the production apparatus which are not represented herein are nonetheless to be considered as falling within the inventive concept.

For example, the apparatus can comprise different movement mechanisms, such as compressed air mechanisms and/ or mechanisms designed to exploit the depression in order to obtain the due deformations, while maintaining the same principles of motion.

With the structural description above, the manufacturing process is as follows.

Once the container 1 made of a paper material has been predisposed, it is positioned in the housing seating 101.

During this stage the paper container 1 exhibits a lateral wall 3 which is substantially smooth and without grooves/ribs or threads.

The closure element 5 is at least partially inserted in the containing chamber 4 such that the lateral wall 7 marries the corresponding portion of the lateral wall 3 of the container 1.

The closure element 5 too exhibits no ribbing/grooves at the lateral wall 7.

The shaped portion 120 of the counter-die 119 is then inserted into the closure element.

In this configuration the apparatus is such that each of the mobile organs 112 exhibiting the ribs 112*a* on the internal end thereof is distanced by some millimeters from the lateral surface of the container 1 (FIG. 3 where for the sake of simplicity the beaker has been removed).

Also the shaped portion 120 of the counter-die 119 is inserted and substantially complementarily-shaped to the lateral wall 7 of the closure element 5.

It is worthy of note however that the shaped portion exhibits respective gullies 120*a* which, in this configuration, define closed cavities superficially on the is smooth lateral wall 7 of the closure element 5.

At this point the activation means are used to move the mobile body 106 in rotation.

By operating in this way each of the mobile organs 112, following the trajectories in the time set by the respective grooved guides 115, is brought first into contact and thus into interference with the lateral wall 3 of the container 1.

When the rotation defined by the activating means 107 is complete, the apparatus is in the configuration of FIG. 6.

As can be noted, a portion of the lateral wall 7 and the closure element 5 and a portion of the lateral wall 3 of the container 1 are interposed and deformed between each of the ribs 112*a* and the respective gullies 120*a*.

Figure 5:
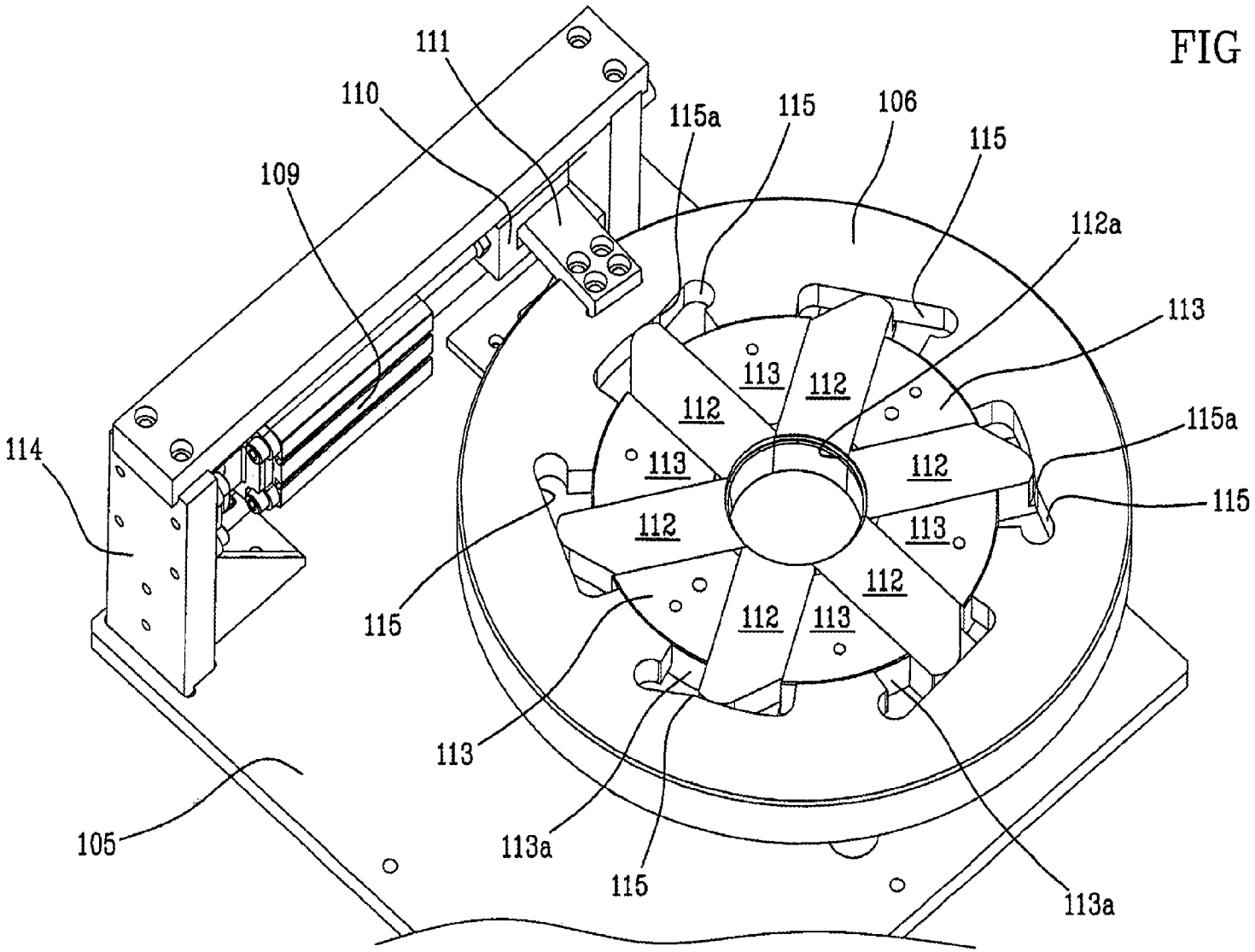

FIG. 5 illustrates the condition of FIG. 6 with the container and the counter-die removed such as to highlight the fact that in the work position the mobile organs 112 define, through the respective ribs 112*a*, a continuous rib with a helical progression.

The gullies 120*a* also define the same progression, in negative form, such that the pressure exerted on the portions of paper material internally of the structures are such as to generate the helical rib on both the containers and the closure element, thus defining a thread which extends for at least 120 degrees and in particular for more than 360 degrees (and still more preferably over 540 degrees such as to define more than a spire and a half of helix on the two parts).

The defined surfaces represent two respective threads which are substantially identical in conditions of engagement and the container and the lid can be constrained to one another by an appropriate rotation.

In the case of the embodiment of FIGS. 6*a* and 7*a*, apart from the distancing of the mobile organs 112 there is also a distancing of the expandable sectors 122 such as to free the threaded container.

In this way a removable coupling of the screw type is defined on the container.

Optionally a further stage of sealing of at least a portion of the closure element 5 can be comprised, and at least a corresponding portion of the container 1.

The stage of sealing can be performed at the same time as the stage of realising is the threads or even in a successive or preceding stage.

Looking at the container of FIG. 2*a*, the flat portion 14 emerging distancingly from the free edge 20 of the container 1 and the corresponding flat portion 12 emerging distancingly from the lateral wall 7 of the closure element 5 can be made to encounter one another, thus defining a reciprocal constraint zone, in the present case annular, for sealing.

By appropriately operating with pressures and heating a partial melting of the polyolefin plastic film cladding the paper material can be obtained, thus ensuring a good and a sterile hold of the two elements.

Note that at least one of the above-cited flat portions 12, 14 (and preferably both) exhibit respective weakened lines 13 for enabling separation of the reciprocally-sealed portions from the container.

The above description enables an external annular closure portion to be removed and to access the contents.

The removal of the permanent closure does not however affect the possibility of then opening and re-closing the container by rotation of the closure element 5.

Another alternative is that it is possible to realise the further constraint zone between the closure element 5 and the container 1 only in at least a portion of the structure 1 and at least a portion of the closure element 5 (or two more separate portions).

It is clear that by doing the above a further constraint zone is created (different from the threaded coupling) that is not hermetically sealed, but with only the function of preventing intrusion.

In other words once the product is packaged the user is in a position to know whether the container has already been used or opened simply by checking on the integrity of the seals.

It is clear that the further constraint zone can be defined at the upper contact perimeter between the free edge 20 of the container of the closure element 5, at the flat surfaces 12, 14, or in other contact zones between the closure element 5 and the lateral wall 3, for example at the upper zone 3*a* with the respective is portion 11 which extends downwards of the closure element 5.

It is also clear that the presence of a plastic film coupled with paper material can be helpful during the stage of realising the sealing (complete or partial).

Finally, each of the technical characteristics illustrated in the specific embodiments can be transposed to other embodiments illustrated in the present document.

In other words the presence of the illustrated sealing element 29, FIG. 9*c* can be used in any of the illustrated embodiments in the other figures, as can the sealing element 28, or also accesses 26 and the corresponding sealing body 27 shown only in FIG. 10*d*.

These technical characteristics have been shown in different embodiments with the sole aim of providing examples and so as not to burden the present description with a plurality of further embodiments combining the cited technical characteristics.

It is not insignificant to stress that the methodology, the container and the apparatus described can (by way of example) be specifically but advantageously applied in machines for automatic distribution of production (vending machines).

For example, drinks vending machines (coffee and the like) are made more complete if they can provide, including by consumer choice, a screw lid such as the one described for closing the container.

This makes possible easier transport and a more secure manipulation of the product, also improving hygienic conditions.

Apparatus of the described type (or modified though maintaining the inventive essence in order better to be adapted to a housing in the dispenser) could automatically position the lid, realise the threading and deliver the product in a closed container ready for use.

Evidently this application also extends to other products apart from drinks, detergents, sweet products, beads, small objects etc.

The proposed method enables a thread and counter-thread to be obtained on the is lid and container which are perfectly married and complementarily-shaped with regard to one another, such as to improve the seal characteristics of the closed container.

Further, the method provides the possibility of being able to operate with undeformed containers and lids, completing the packaging of the product and thus realising the removable closure element only once the product has already been inserted into the container.

In other words, the present method can be exploited with containers of known type and with closure elements which are also on the market, enabling realisation of the threading both during the production stage and during the stage of packaging according to needs.

The constructional simplicity of the apparatus for obtaining the deformations further enables designing and realising machines that are not automatic for manually realising the threads actually at the sales point of the product.

The use of extensible paper for defining the container and/or the closure element enable optimisation of the fluid seal of the coupling and also obtaining deformations that would be impossible to achieve with normal paper on each of the two elements.

Finally, the possibility of realising a further sealing closure system guarantees conservation of the contents while preventing any type of possible leakage of the product to the outside, while maintaining the operating possibility of removably opening and closing the container on the part of the user.

Both the container and the closure element are made of paper material and therefore enable after-use refuse disposal to be done with simple operations.

The invention claimed is:

1. A process for realizing a container from a foldable sheet, comprising:

predisposing a container made of a sheet material defining internally thereof a chamber, the chamber exhibiting at least an access delimited by a portion of wall of the container and by a free edge of the wall;

predisposing a closure element made of a sheet material comprising a base wall and a lateral wall emerging from the base wall;

associating the closure element to the container such as to at least partially close the access, the lateral wall of the closure element being positioned at the portion of the wall of the container; and after association, deforming at least a part of the lateral wall of the closure element and at least a part of the portion of wall of the container in order to realize corresponding grooves on the parts which grooves are destined to define coupling and decoupling surfaces by rotation between the closure element and the container, wherein the deforming step enables grooves to be obtained on the container element in reciprocal coupling conditions thereof.

2. The process of claim 1, wherein the step of predisposing a container comprises predisposing a container made of paper material defining internally thereof at least a housing chamber, the chamber exhibiting at least an access delimited by a portion of wall of the container and by a free edge of the wall, and said associating step comprises associating the container to the closure element made of paper material in a configuration to at least partially insert, through the access, the base wall of the closure element in the containing chamber, the lateral wall of the closure element being inserted internally of the containing chamber at the portion of wall of the container.

3. The process of claim 1, wherein each of the grooves defines respective threads extending on the surface over a development of more than 120 degrees.

4. The process of claim 1, wherein each of the grooves defines respective threads extending on the surface over a development of more than 360 degrees.

5. The process of claim 1, wherein each of the grooves defines respective threads extending on the surface over at least a development of 540 degrees.

6. The process of claim 1, wherein the deforming step comprises a sub-stage of insertion of the cavity of the container of a shaped portion exhibiting respective gullies facing towards an outside of the shaped portion and further sub-stages of predisposing mobile deformation organs externally of the container exhibiting respective ribs substantially complementarily shaped to the gullies of the shaped portion and moving the mobile organs in a nearing direction to the container such as to insert the ribs internally of the gullies, corresponding parts of the lateral wall of the closure element and the portion of the lateral wall of the container being imprisoned between gullies and ribs being deformed, following the nearing, in order to define the grooves for coupling/decoupling by rotation between the closure element and the container.

7. The process of claim 6, wherein the sub-stage of movement of the organs comprises a nearing of the organs to the shaped portion in a direction contained in a perpendicular plane to an axis of development of the container, the direction being substantially a radial direction.

8. The process of claim 6, wherein each mobile organ exhibits respective ribs, in locking condition on the container, the ribs of all the mobile organs defining a continuous rib in a helical shape.

9. The process of claim 1, further comprising sealing at least a portion of the closure element with at least a corresponding portion of the container.

10. An apparatus for controlled deformation of a container made of a sheet material, the apparatus comprising:

a structure exhibiting at least a seating for housing at least a part of the container, the container being provided with a closure element located at a containing chamber of the container;

a shaped portion located at the central seating in order to be, in use, inserted at least in part internally of the containing chamber, the shaped portion exhibiting respective gullies facing externally of the shaped portion;

mobile organs located in use about the seating and exhibiting respective ribs destined to cooperate in use with the gullies of the shaped portion;

activating means for displacing the mobile organs between a rest condition distanced from the shaped portion and a working position in which the ribs are at least partly inserted in the gullies; and wherein said container and said closure element is positioned between said shaping portion and said mobile organs.

11. The apparatus of the preceding claim 10, further comprising a mobile body exhibiting respective grooved guides, the activating means being active in order to move the mobile body by oscillation about an axis, each mobile organ being engaged to a respective grooved guide, the movement of the mobile body bringing a corresponding nearing/distancing motion of each mobile organ to the shaped portion, the nearing/distancing motion being commanded by the shape of the grooved guides.

12. The apparatus of claim 10, wherein the shaped portion exhibits a plurality of expandable sectors each exhibiting the gullies destined to cooperate with the ribs, the expandable sectors being mobile between a retracted position in which they enable extraction of the container exhibiting the grooves and a work position in which they are substantially in contact with the container and cooperate with the ribs of the mobile organs.

* * * * *